US005780786A

United States Patent [19]

Miyanishi

[11] Patent Number: 5,780,786

[45] Date of Patent: Jul. 14, 1998

[54] CONTROL APPARATUS FOR USE IN AN ELEVATOR

[75] Inventor: Yoshio Miyanishi, Tokyo, Japan

[73] Assignee: Mitsubishi Denki Kabushiki Kaisha, Tokyo, Japan

[21] Appl. No.: 721,718

[22] Filed: Sep. 27, 1996

[30] Foreign Application Priority Data

Mar. 29, 1996 [JP] Japan ..... 8-077472

[51] Int. Cl.[6] ..... B66B 5/14; B66B 1/28; B66B 1/34

[52] U.S. Cl. ..... 187/293; 187/281; 187/393

[58] Field of Search ..... 187/293, 286, 187/281, 393, 392, 391

[56] References Cited

U.S. PATENT DOCUMENTS

| | | | |
|---|---|---|---|
| 3,735,221 | 5/1973 | Bell et al. | 318/151 |
| 4,155,426 | 5/1979 | Booker, Jr. | 187/29 R |
| 5,229,558 | 7/1993 | Hakala | 187/118 |
| 5,266,757 | 11/1993 | Krapek et al. | 187/116 |

FOREIGN PATENT DOCUMENTS

| | | |
|---|---|---|
| 57-175668 | 10/1982 | Japan . |
| 61-243781 | 10/1986 | Japan . |
| 64-22774 | 1/1989 | Japan . |

*Primary Examiner*—Robert Nappi
*Attorney, Agent, or Firm*—Leydig, Voit & Mayer, Ltd.

[57] ABSTRACT

A control apparatus for use in an elevator is constructed in a compact and low-cost design without degrading the quality of service of the elevator by minimizing the current flowing through a hoisting motor. The control apparatus includes a load sensor and a speed command generator. The speed command generator alters acceleration and deceleration according to an elevator car net load and the direction of run by setting both the acceleration during acceleration phase and the deceleration during deceleration phase to be a first acceleration when the car net load is within a normal load region, setting the acceleration to be a second acceleration that is lower than the first acceleration and the deceleration to be a third acceleration that is higher than the first acceleration when the car is in a lower operation with the car net load in a light load region, setting the acceleration to be the third acceleration and the deceleration to be the second acceleration when the car is in a raise operation with the car net load being within the light load region, setting the acceleration to be the second acceleration and the deceleration to be the third acceleration when the car is in the raise operation with the car net load being within a heavy load region, and setting the acceleration to be the third acceleration and the deceleration to be the second acceleration when the car is in the lower operation with the car net load being within the heavy load region.

11 Claims, 18 Drawing Sheets

CONTROL APPARATUS FOR USE IN AN ELEVATOR

BACKGROUND OF THE INVENTION

1. Field of the Invention

The present invention relates to improvements of a control apparatus for use in an elevator, and more specifically, to an elevator control apparatus that is constructed in a compact and low-cost design without degrading the quality of service of the elevator by minimizing the current flowing through a hoisting motor.

2. Description of the Related Art

FIG. 15 is a block diagram showing generally the known control apparatus of an elevator.

Shown in FIG. 15 are a three-phase AC power supply 1, a converter 2 for rectifying the AC into the DC, a smoothing capacitor 3, and an inverter 4 for inverting the DC into an AC of arbitrary frequency and voltage, wherein the inverter 4 together with the converter 2 constitutes power converter means. Also shown are a hoisting motor 5, an elevator car 6, a counterweight 7, a main rope 8, a governor 9, a tension pulley 10, a speed sensor 11 such as a rotary encoder mounted on the hoisting motor 5 and outputting a detected speed signal 11*a*, a position sensor 12 such as a rotary encoder mounted on the governor 9 and outputting a detected position signal 12*a* which is sent to a speed command generator 18, a destination button 13 installed in the car 6 and outputting a button signal 13*a*, a load sensor 14, such as net load sensor for sensing the load in the car 6 and outputting a detected load signal 14*a* indicative of the load in the car 6, and a boarding button 15 outputting a button signal 15*a*.

Shown further in FIG. 15 are a group management unit 16 for managing a plurality of elevators and outputting an assignment signal 16*a*, an operation management unit 17 for controlling the operation of each elevator and outputting an operation command 17*a* and direction signal 17*b*, the speed command generator 18 for computing a speed command 18*a* based on a distance of travel, a speed control unit 19 which controls the converter 2 and the inverter 4 to drive the motor 5 using driving commands 19*a*, 19*b*, current detectors 20, 21 outputting detected current signals 20*a*, 21*a*, and the elevator control apparatus 22.

Designated 19*c* and 18*b* are the signal issued from the speed control unit 19 to the speed command generator 18 and the signal issued from the speed command generator 18 to the operation management unit 17, respectively, and as the signals 19*c* and 18*b*, a car net load signal or detected current signal are sent from the speed control unit 19 to the operation management unit 17 via the speed command generator 18, and the operation management unit 17 ignores a boarding call that originates at an intermediate floor and passes that floor without stopping, for example, when the car net load signal indicates that the car is full of passengers or freight.

FIG. 16 shows the internal construction of the speed command generator 18.

Shown in FIG. 16 are a central processor unit (hereinafter CPU) 23, a read-only memory (hereinafter ROM) 24, a random-access memory (hereinafter RAM) 25, interfaces (hereinafter I/F) 26, 27 for data exchange with the speed control unit 19 and the operation management unit 17, a counter 28 for counting the pulses of the detected position signal 12*a* and a data bus 29.

Discussed next is the operation of the control apparatus of the elevator thus constructed, referring to the flow diagram in FIG. 17 showing the process taken in the speed command generator 18, the characteristic curve of the speed command signal 18*a* in FIG. 18, and the relationship of speed, acceleration and current in FIG. 19.

In FIG. 15, when the boarding button 15 is pressed, the button signal 15*a* is collected by the group management unit 16, which in turn selects the optimum car for an efficient elevator operation and outputs the assignment signal 16*a*. The operation management unit 17 issues the operation command 17*a* and direction signal 17*b* to the speed command generator 18 in response to the assignment signal 16*a* and the button signal 13*a* generated by the destination button 13 mounted in the elevator car 6.

The speed command generator 18 goes to step S2 from step S1 in FIG. 17 when no operation command exists, namely the elevator is at standby. At step S2, speed command $V_P$, run mode MODE and time T are set to 0 at their initial settings. MODE is set to be 0 during standby, 1 during acceleration, 2 during rated speed running, and 3 during retardation or deceleration phase. At the start of the elevator, the speed $V_B$ ($=V_{TOP}-V_A$) at the point where the elevator starts gradually reducing its acceleration from a constant acceleration is computed while a maximum speed $V_C$ and rated speed $V_{TOP}$ are set. $V_A$ is the speed at the point where the elevator reaches a constant acceleration after the startup, and computed as follows:

$$V_A=\alpha_1 T_1 \cdot 2 \ [m/s^2]$$

where, $\alpha_1$ is an acceleration, and $T_1$ is a jerk time (during which the jerk is not zero, namely, the acceleration is varying) as shown in FIGS. 18 and 19.

When an operation command is issued, the sequence goes to step S4 from step S3 in FIG. 17, and MODE is set to be 1 for acceleration. The sequence goes to step S6 from step S5 until the command speed $V_P$ reaches $V_A$, while the speed command $V_P$ is computed as follows:

$$V_P=\alpha_1 T_2 \cdot (2T_1)$$

at the same time, time T is set to be $+\Delta T$. $\Delta T$ is the operation cycle to perform the process shown in FIG. 17.

The speed command $V_P$ reaches $V_A$ but is equal to or smaller than $V_B$, the sequence follows steps S5→S8→S9, and by adding a $\Delta V_P$ to the command speed $V_P$, the speed command during constant acceleration is computed. $\Delta V_P$ herein is $\alpha_1 \times T$ [m/s].

At step S10, the distance $S_R$ remaining to a destination floor is compared with a deceleration distance $S_D$. The deceleration distance $S_D$ is the distance required for stopping at the destination floor, and is indicated by the area of the hatched portion in FIG. 18.

When the distance between the starting floor and the destination floor is long enough to reach the rated speed, the speed command $V_P$ is approximated by the characteristic curve (A) in FIG. 18, and the deceleration distance $S_D$ is computed as follows:

$$T_2 = (V_B - V_A) \div 2$$

$$\begin{aligned} S_D &= (2T_1 + T_2)V_A + T_1(V_B - V_A) + \\ &\quad T_2(V_B - V_A) \div 2 \\ &= (T_1 + T_2 \div 2)(V_A + V_B) \end{aligned}$$

When the distance between the starting floor and the destination floor is too short to reach the rated speed, the speed command $V_P$ is approximated by the characteristic curve (B) in FIG. 18, and the deceleration distance $S_D$ is computed as follows:

$$T_2 = (V_P - V_A) \div 2$$

$$\begin{aligned} S_D &= (2T_1 + T_2)V_A + T_1(V_P - V_A) + \\ &\quad T_2(V_P - V_A) \div 2 + T_1(V_P + V_A) - \\ &\quad \alpha_1 T_1^2 \div 6 \\ &= (T_1 + T_2 \div 2)(V_A + V_P) + T_1(V_P + V_A) - \\ &\quad \alpha_1 T_1^2 \div 6 \\ &= (2T_1 + T_2 \div 2)(V_A + V_P) - \alpha_1 T_1^2 \div 6 \end{aligned}$$

When the distance between the starting floor and the destination floor is long enough to reach the rated speed, the condition $S_R \leqq S_D$ is not established during acceleration, and the sequence goes to the exit from step S10.

When the distance between the starting floor and the destination floor is too short to reach the rated speed, the above operation applies until the condition $S_R \leqq S_D$ is established. When the condition $S_R \leqq S_D$ is established, the current speed command $V_P$ is set to $V_B$ at step S11, the maximum speed $V_C$ is changed to $V_P + V_A$, and the time T is reset to 0. At the next operation cycle, the sequence goes to step S12 from step S8, and the speed command is computed until the maximum speed $V_C$ is reached.

$$V_P = V_B - \alpha_1 T_2 \cdot (2T_1) + \alpha_1 T$$

When the speed command $V_P$ reaches the maximum speed $V_C$, the sequence goes from step S13 to step S14, where MODE is set to be 2, namely to rated speed running.

After MODE=2 is reached, the sequence follows steps S7 S15→S16. The maximum speed $V_C$ is set to $V_P$. At step S17, the distance $S_R$ remaining is compared with the deceleration distance $S_D$. When the condition $S_R \leqq S_D$ is reached, MODE is set to 3, namely to deceleration. In the course of deceleration from the maximum speed $V_C$ to $V_B$, the sequence goes from step S19 to S20, where a speed command $V_{D3}$ is computed. In the course of deceleration from $V_B$ to $V_A$, the sequence goes from step S21 to step S22, where a speed command $V_{D2}$ is computed. In the course of deceleration from $V_A$ to a halt, the sequence goes from step S21 to step S23, where a speed command $V_{D1}$ is computed. $V_{D1}$ through $V_{D3}$ are computed in response to the distance remaining $S_R$ according to the following equations. The order of the equation is increased. Thus, in many cases, a plurality of the speed command values computed beforehand on a per distance basis are stored in the ROM 24 in the speed command generator 18 in FIG. 15, and the computed value of the distance nearest to the distance remaining $S_R$ is retrieved.

$$V_{D1} = \alpha_1 T^0 \cdot (6T_1),\ S_R = \alpha_1 T^0 \cdot (6T_1)$$

$$V_{D2} = \alpha_1 T - \alpha_1 T_1 \cdot 2,\ S_R = \alpha_1 T^2 19\ 2 - \alpha_1 T_1 T \cdot 2$$

$$V_{D3} = \alpha_1 (T_1 + T_2) - \alpha_1 T_2 \cdot (2T_1),\ S_R = \alpha_1 (T_1 + T_2) T = \alpha_1 T_3 \cdot (6T_1)$$

In this way, the speed command generator 18 computes the speed command $V_P$, but its acceleration and deceleration is fixed to $\alpha_1$ as shown in the waveform (B) in FIG. 19. When the car 6 balances the counterweight 7 in a balanced load operation, the current $I_1$ for acceleration and the current $I_2$ for deceleration are approximately equal in magnitude. Since the motor must output more torque during no-load lower operation or rated load raise operation than during balanced load operation as shown in the waveform (D) in FIG. 19, the current $I_3$ for acceleration increases accordingly. Conversely, the current $I_4$ for deceleration decreases than during the balanced load operation.

The current $I_5$ for acceleration gets slightly smaller during rated load lower operation or no-load raise operation than during the balanced load operation as shown in the waveform (E) in FIG. 19. Conversely, the current $I_6$ for deceleration gets larger than during the balanced load operation. Both the current $I_3$ for acceleration during the no-load lower operation and the rated load raise operation and the current $I_6$ for deceleration during the rated load lower operation and the no-load raise operation are greater than the current $I_1$ for acceleration during the balanced load operation.

This requires that the inverter 4 and the like should have a capacity large enough to output the currents $I_3$ and $I_6$, and thereby renders the control apparatus 22 expensive and bulky.

A solution to this may be to lower acceleration and deceleration without reserve. The time required to travel the same distance is longer at lowered acceleration and deceleration than at normal acceleration and deceleration. This will degrade the quality of service of the elevator.

SUMMARY OF THE INVENTION

The present invention has been developed to solve the above-described problems associated the known art, and it is an object of the present invention to provide an elevator control apparatus that is constructed in a compact and low-cost design without degrading the quality of service of the elevator by minimizing the current flowing through a hoisting motor.

To achieve the above object, the control apparatus of an elevator according to the present invention comprises power converter means for converting an alternating current into an alternating current of arbitrary frequency and voltage, a hoisting motor of the elevator powered by the power converter means, load sensor means for sensing the net load in an elevator car, an operation management unit for issuing a operation command and a direction signal of the elevator car in response to a button signal generated by a destination button installed in the elevator car or by a boarding button installed at an elevator station, a speed command generator for computing the speed command responsive to the distance to a destination floor based the operation command and direction signal of the elevator car issued by the operation management unit and the detected load signal from the load sensor means, and a speed control unit for speed controlling the hoisting motor by issuing a driving command to the power converter means in response to the speed command from the speed command generator, whereby the speed command generator, as the speed command to the speed control unit, sets both the acceleration of the speed command during acceleration phase and the deceleration of the speed command during deceleration phase to be a first acceleration when the car net load is within a normal load region inclusive of a balanced load, sets the acceleration of the speed command during acceleration phase to be a second acceleration that is lower than the first acceleration and the deceleration of the speed command during deceleration phase to be a third acceleration that is higher than the first acceleration when the car is in a lower operation with the car net load being in a light load region which is closer to the no-load side of the car elevator and away from the normal load region, sets the acceleration of the speed command during acceleration phase to be the third acceleration and the deceleration of the speed command during deceleration phase to be the second acceleration when the car is in a raise operation with the car net load being within the light load region, sets the acceleration of the speed command during acceleration phase to be the second acceleration and the deceleration of the speed command during deceleration phase to be the third acceleration when the car is in the raise operation with the car net load being within a heavy load region of rated load beyond the normal load region, and sets the acceleration of the speed command during acceleration phase to be the third acceleration and the deceleration of the speed command during deceleration phase to be the second acceleration when the car is in the lower operation with the car net load being within the heavy load region, so that the acceleration and deceleration are altered according to the car net load and the direction of run of the car. The current flowing through the hoisting motor is thus minimized, and a low-cost and compact elevator control apparatus is provided without degrading the quality of service.

When a fault in the load sensor means is detected, the speed command generator issues the acceleration and deceleration smaller than normal acceleration, by setting both the acceleration during acceleration phase and the deceleration during deceleration phase to be the second acceleration. This prevents a current in excess of the capacity of the hoisting motor from flowing through the hoisting motor via power supply side units such as the inverter, and serves the safety purpose of the elevator.

The control apparatus of the present invention further comprises current detector means for detecting the current flowing through the hoisting motor for raising the elevator car, whereby the speed command generator starts with both the acceleration during acceleration phase and the deceleration during deceleration phase set to be either the first acceleration or the third acceleration when a fault in the load sensor means is detected, and thus based on the current value during acceleration phase detected by the current detector means, the deceleration during deceleration phase and the acceleration during acceleration phase are altered. This arrangement minimizes the current flowing through the hoisting motor, resulting in a low-cost and compact elevator control apparatus without degrading the quality of elevator service.

The control apparatus of the present invention further comprises current detector means for detecting the current flowing through the hoisting motor for raising the elevator car, whereby the speed command generator starts with both the acceleration during acceleration phase and the deceleration during deceleration phase set to be either the first acceleration or the third acceleration, and thus based on the detected current value during acceleration phase detected by the current detector means, the deceleration during deceleration phase and the acceleration during acceleration phase are altered. When no load sensor means is employed or when the fault in the load sensor means is not recognized as a fault, the load condition of the car is determined based on the detected current during acceleration phase. Both the acceleration during acceleration phase and the deceleration during deceleration phase are started at either the first acceleration or the third acceleration, and thus based on the current value during acceleration phase detected by the current detector means, the deceleration during deceleration phase and the acceleration during acceleration phase are altered. This arrangement minimizes the current flowing through the hoisting motor, resulting in a low-cost and compact elevator control apparatus without degrading the quality of elevator service.

The speed command generator starts with the acceleration during acceleration phase and the deceleration during deceleration phase set to be the first acceleration, sets the deceleration during deceleration phase to be the second acceleration when the current detected during acceleration by the current detector means is lower than a first predetermined value, and sets the deceleration during deceleration phase to be the third acceleration when the current detected during acceleration by the current detector means is higher than a second predetermined value that is higher than the first predetermined value, while the acceleration during acceleration phase is altered to the second acceleration. The startup is performed at the acceleration and deceleration that are lower than the normal acceleration to increase safety by preventing a current in excess of the capacity of power supply units such as the inverter from flowing therethrough. After the startup, the deceleration is determined by judging the load condition by the detected current value during acceleration phase while the acceleration is also altered, if possible. This arrangement avoids degradation of the quality of service arising from a possible prolonged time; the time required to travel the same distance can be otherwise prolonged according to the degree of decrease that the acceleration and deceleration are decreased at the startup.

The speed command generator starts with the acceleration during acceleration phase and the deceleration during deceleration phase set to be the third acceleration, and sets the deceleration during deceleration phase to be the second acceleration when the current detected during acceleration phase by the current detector means is lower than the second predetermined value, and sets the deceleration during deceleration phase to be the first acceleration when the current detected during acceleration phase by the current detector means is higher than the second predetermined value, while the acceleration during acceleration phase is altered to the second acceleration. The startup is performed at the acceleration and deceleration that are higher than the normal acceleration to shorten the time required to travel the same distance according to the degree of increase that the acceleration and deceleration are increased at the startup, and thus to avoid the degradation of service quality of the elevator. In succession to the startup, the acceleration and deceleration are altered by determining the load condition by the current value detected during acceleration phase, and a current in excess of the capacity of the power supply units such as the inverter is prevented from flowing therethrough.

The speed command generator starts with the acceleration during acceleration phase and the deceleration during deceleration phase set to be the second acceleration, and sets the deceleration during deceleration phase to be the third acceleration when the current detected during acceleration phase by the current detector means is higher than the first predetermined value, and sets the deceleration during deceleration phase to be the second acceleration when the current detected during acceleration phase by the current detector means is lower than the first predetermined value, while the acceleration during acceleration phase is altered to the second acceleration. The startup is performed at the acceleration and deceleration that are lower than the normal acceleration to increase safety by preventing a current in excess of the capacity of power supply units such as the inverter from flowing therethrough. After the startup, the acceleration and deceleration are determined by judging the load condition by the detected current value during acceleration phase. This arrangement avoids degradation of the quality of service arising from a possible prolonged time; the time required to travel the same distance can be otherwise prolonged according to the degree of decrease that the acceleration and deceleration are decreased at the startup.

The control apparatus of the present invention further comprises position sensor means for detecting the current position of the elevator car, whereby the speed command generator starts with both the acceleration during acceleration phase and the deceleration during deceleration phase set to be the first acceleration while determining that the car net load is within the normal load region inclusive of the balanced load when a fault is detected in the load sensor means, and sets the acceleration during acceleration phase to be the second acceleration and the deceleration during deceleration phase to be the third acceleration based on the signal from the position sensor means when the car moves in a running direction after the distance run in the reverse direction gets longer than a predetermined distance. Thus, determining that the torque during acceleration phase increases drawing a larger current when the car moves in reverse at the startup, the acceleration and deceleration are selected by determining the load condition according to the distance of reverse travel of the car immediately after the release of a brake. This arrangement minimizes the current flowing through the hoisting motor, resulting in a low-cost and compact elevator control apparatus without degrading the quality of elevator service.

The control apparatus of the present invention further comprises position sensor means for detecting the current position of the elevator car, whereby the speed command generator starts with both the acceleration of the speed command during acceleration phase and the deceleration of the speed command during deceleration phase set to be the first acceleration while determining that the car net load is within the normal load region inclusive of the balanced load, and sets the acceleration during acceleration phase to be the second acceleration and the deceleration during deceleration phase to be the third acceleration based on the signal from the position sensor means when the car moves in a running direction after the distance run in the reverse direction gets longer than a predetermined distance. When no load sensor means is employed or when the fault in the load sensor means is not recognized as a fault, the load condition of the car is determined based on the distance of reverse travel. Determining that the torque during acceleration phase increases drawing a larger current when the car moves in reverse at the startup, the acceleration and deceleration are selected by determining the load condition according to the distance of reverse travel of the car immediately after the release of a brake. This arrangement minimizes the current flowing through the hoisting motor, resulting in a low-cost and compact elevator control apparatus without degrading the quality of elevator service.

DESCRIPTION OF THE PREFERRED EMBODIMENTS

Embodiment 1

Figure 1:
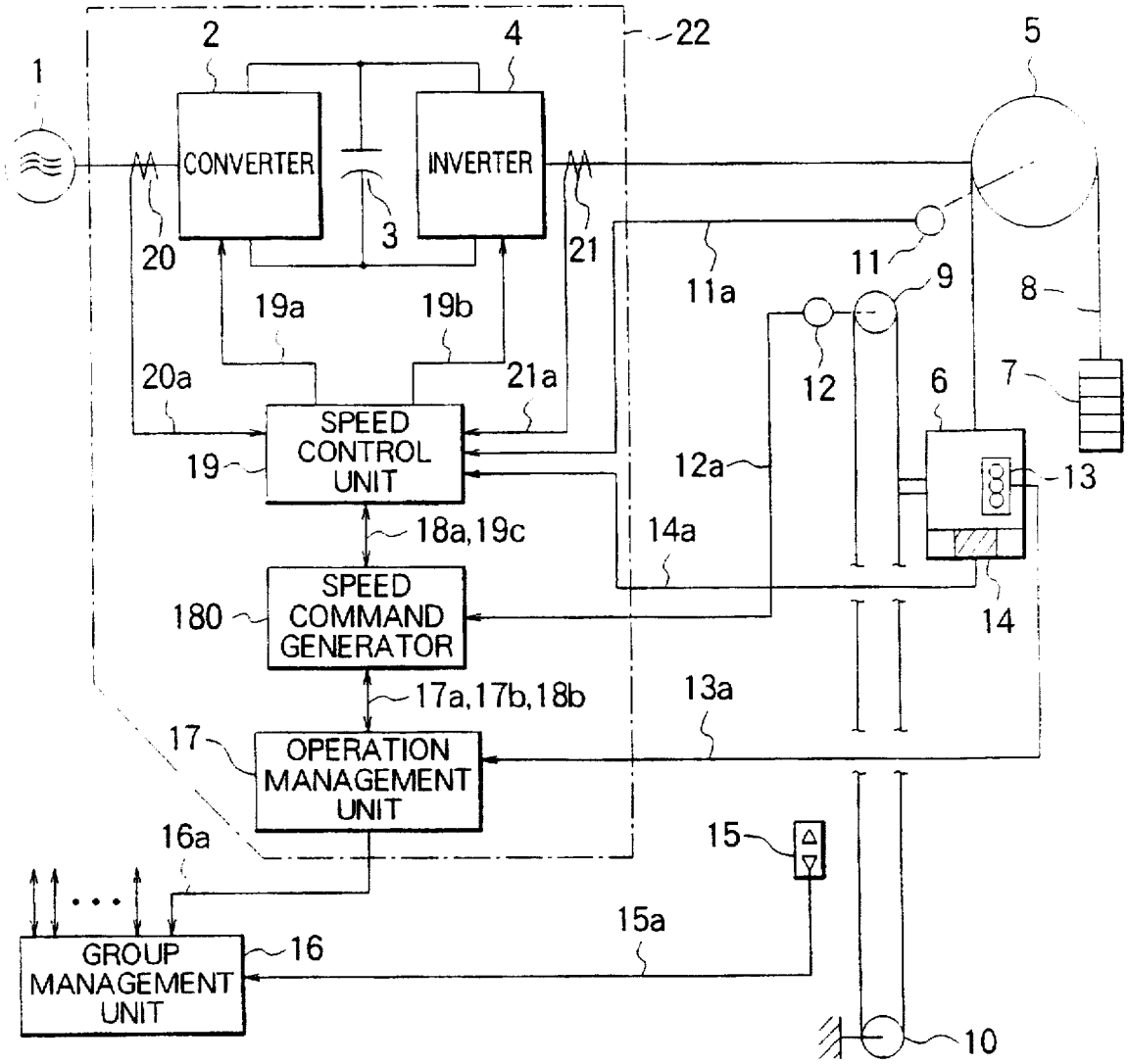
FIG. 1 is a block diagram showing generally the elevator control apparatus according to the present invention.
Figure 2:
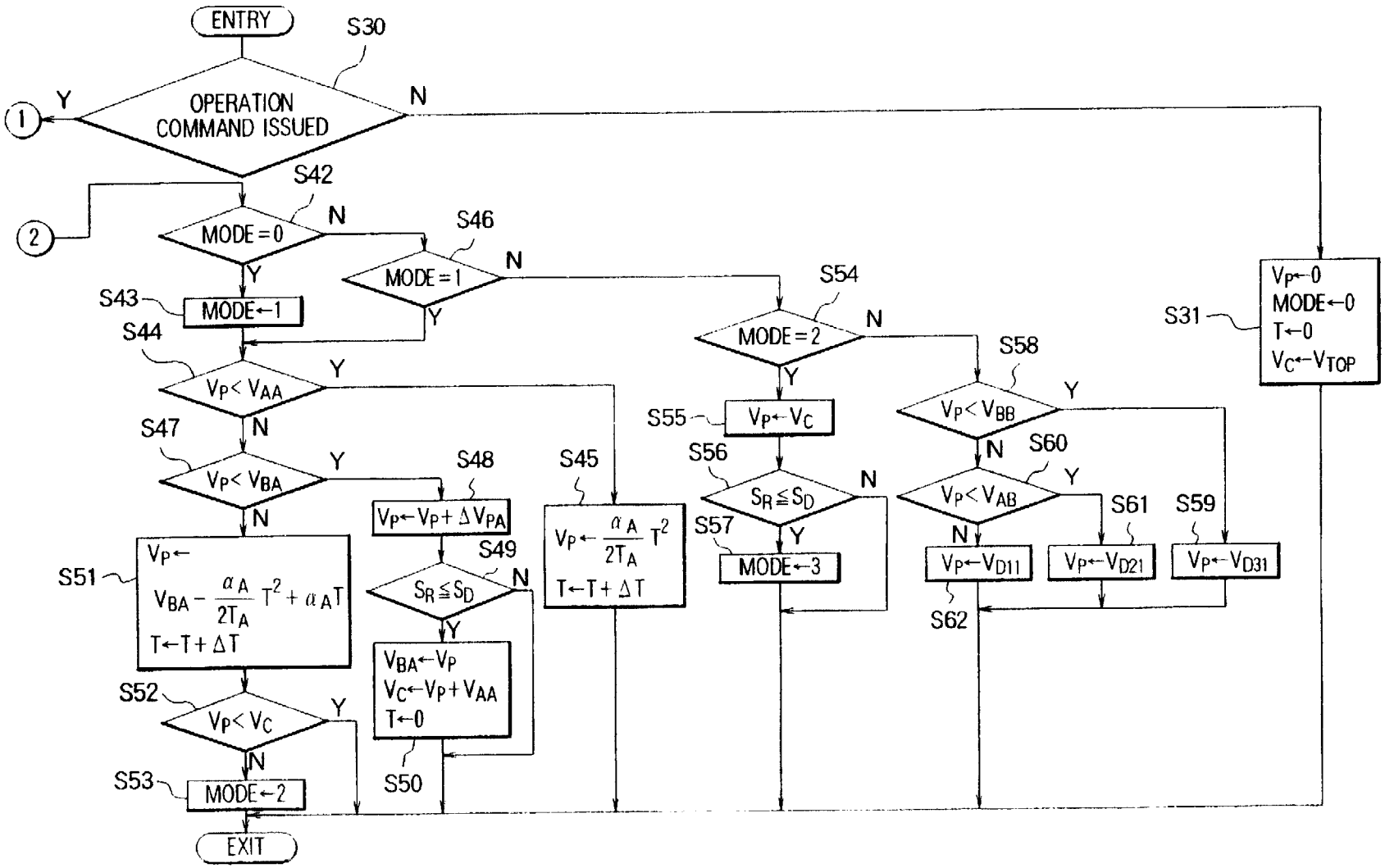
FIG. 2 is a flow diagram showing the speed command computation process according to embodiment 1 of the speed command generator of FIG. 1.
Figure 3:
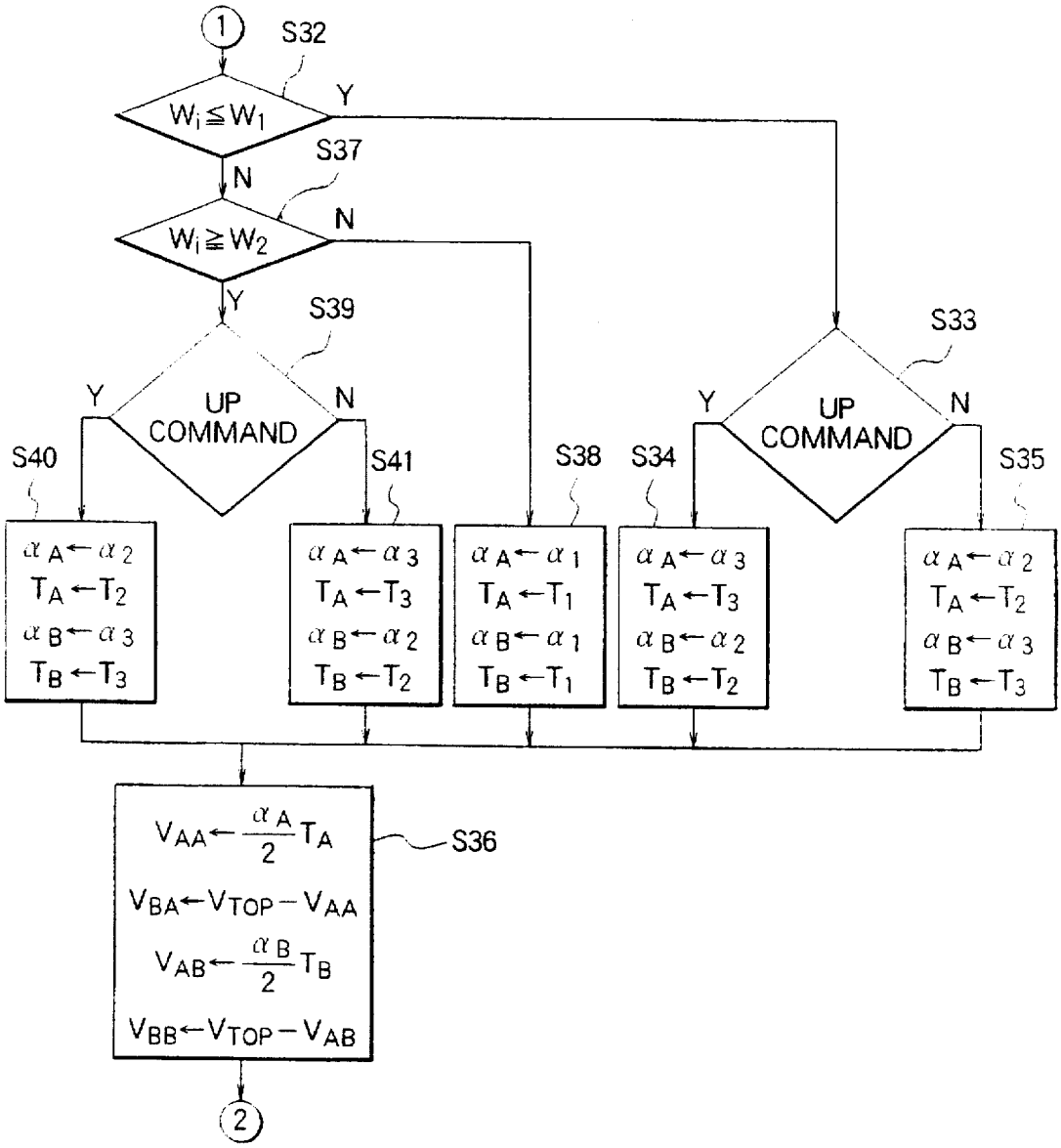
FIG. 3 shows part of the speed command computation process according to embodiment 1 in FIG. 2.

FIG. 1 is the block diagram showing generally the elevator control apparatus according to the present invention. FIGS. 2 and 3 are flow diagrams showing the speed command computation process according to embodiment 1 of the speed command generator 180 of the elevator control apparatus of FIG. 1.

Figure 15:
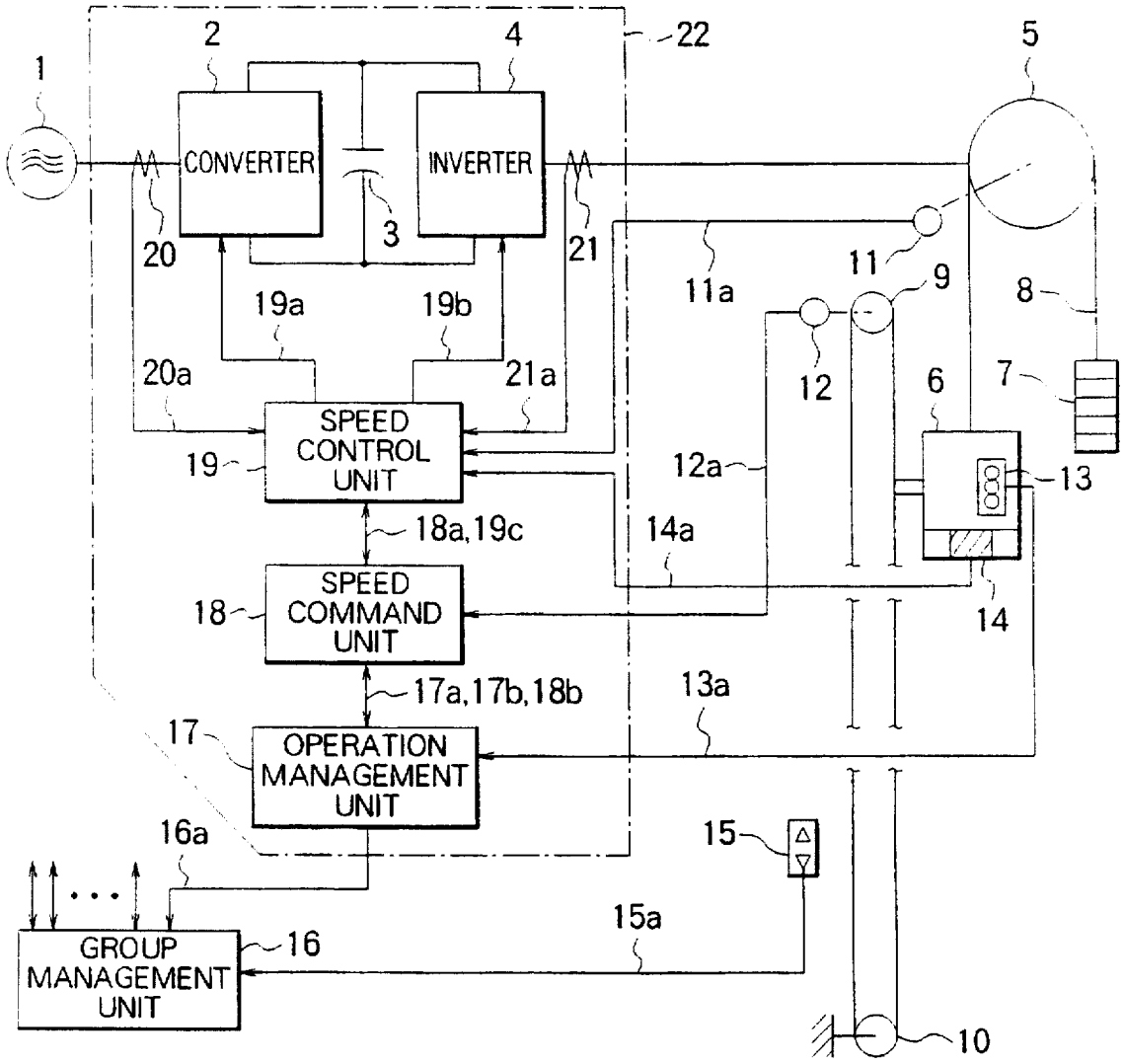
FIG. 15 (PRIOR ART)
FIG. 15 is a block diagram showing generally the known art elevator control apparatus.
Figure 16:
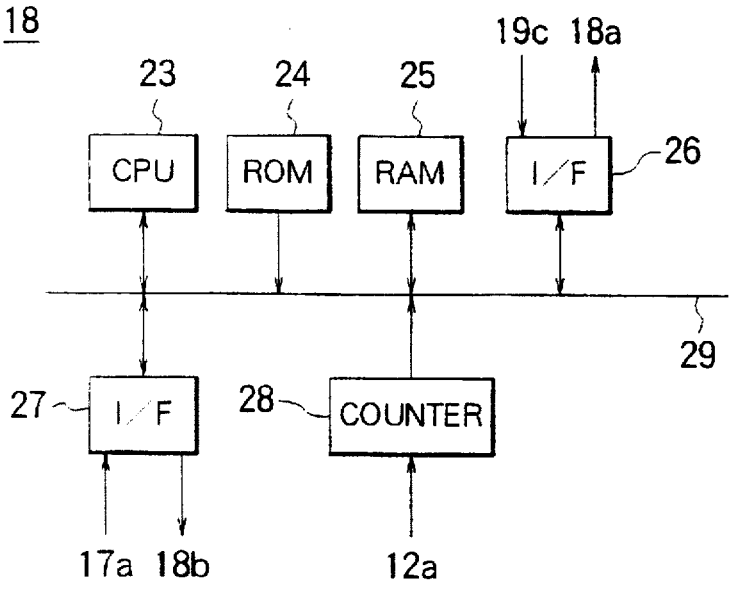
FIG. 16 (PRIOR ART)
FIG. 16 is a block diagram of internal construction of the speed command generator of FIG. 15.
Figure 17:
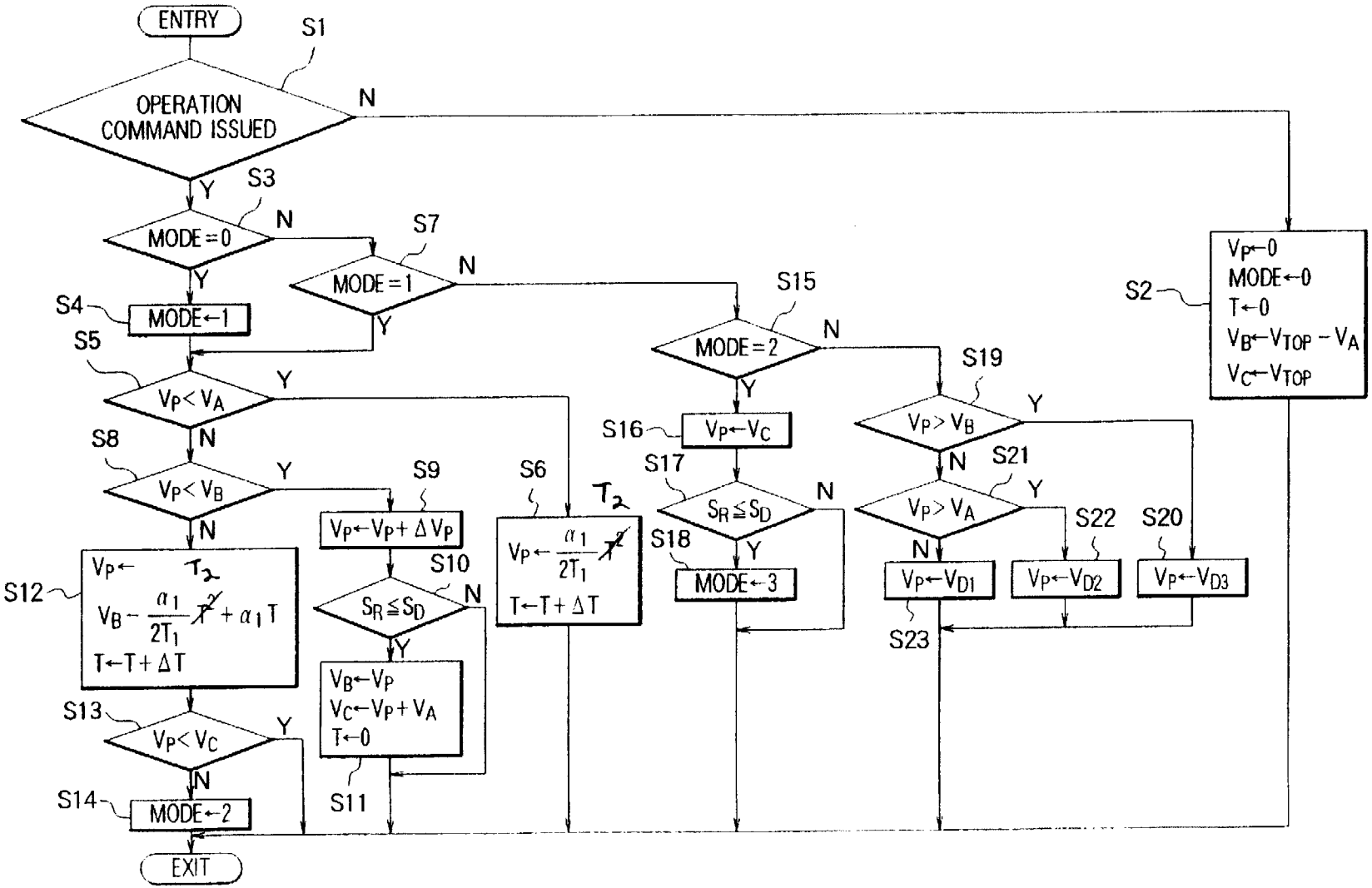
FIG. 17 (PRIOR ART)
FIG. 17 is a flow diagram showing the process of the speed command generator of FIG. 15.
Figure 18:
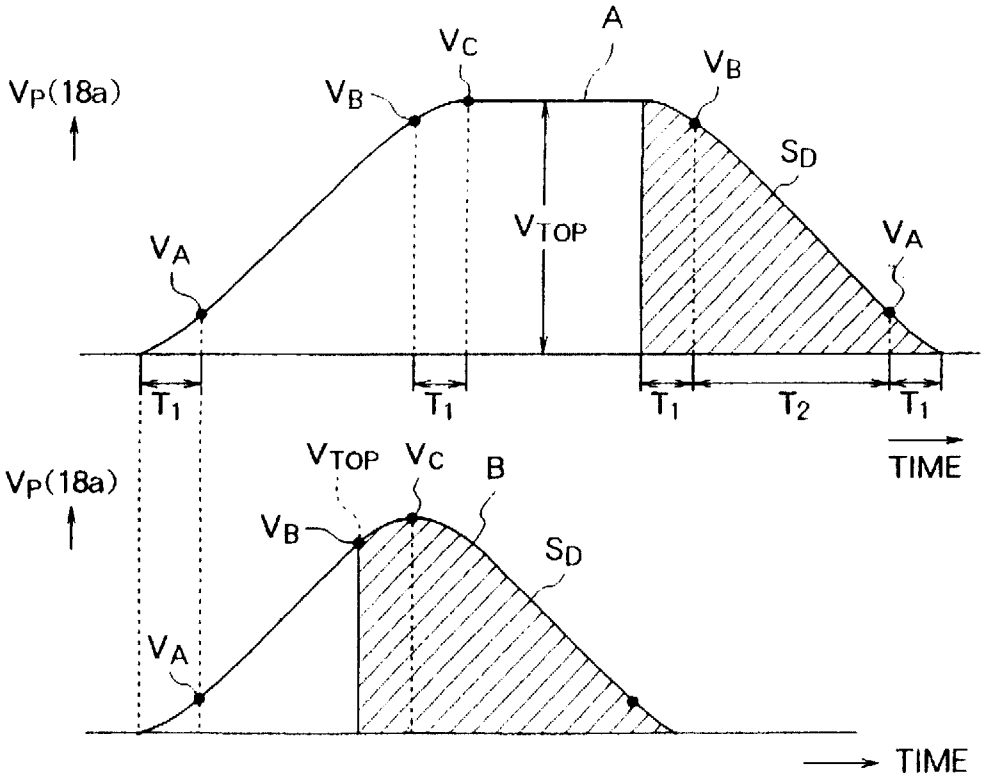
FIG. 18 (PRIOR ART)
FIG. 18 shows is a graph of the characteristic curve of the speed command signal 18*a* output by the speed command generator of FIG. 15.
Figure 19:
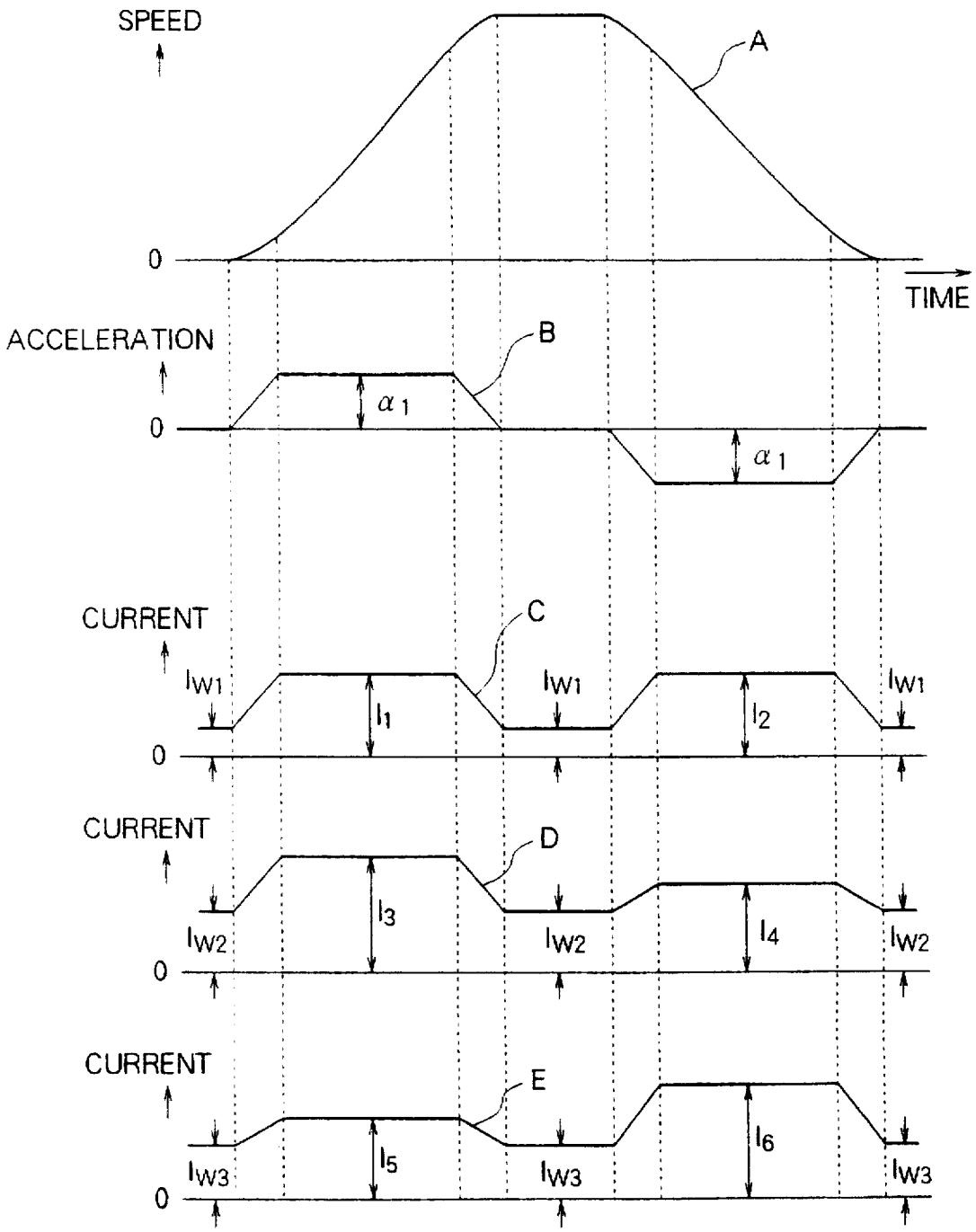
FIG. 19 (PRIOR ART)
FIG. 19 is a graph of the relationship of a speed, acceleration and current according to the process of the speed command generator of FIG. 15.

The elevator control apparatus according to the present invention shown in FIG. 1 has constructions similar to those in FIGS. 15 and 16, wherein FIG. 15 shows the general construction of a conventional elevator control apparatus and FIG. 16 shows the internal construction of the speed command generator. Although the speed command generator 180 of the present invention computes the speed command signal 18*a* (speed command $V_P$) as shown in the characteristic curve in FIG. 18, the elevator control apparatus of this invention differs from the known art in that the speed command computation process in the speed command generator 180 allows the acceleration and deceleration to be altered according to the car net load (net weight) and the direction of run.

Figure 4:
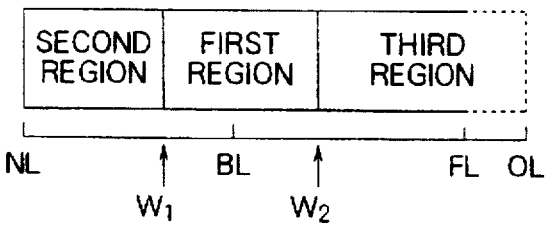
FIG. 4 is an explanatory diagram of the speed command computation process according to embodiment 1, showing the range of setting of the car net load (net weight) used in the course of the alteration of the acceleration and deceleration.

The operation of the speed command computation process according to the embodiment 1 is now specifically discussed referring to the flow diagrams of the speed command computation process of the speed command generator 180 shown in FIGS. 2 and 3, the explanatory diagram in FIG. 4 that shows the range of setting of the car net load (net weight) used in the course of the alteration of the acceleration and deceleration and the characteristic diagram in FIG.

5 that shows the relationship between the acceleration and the current when the elevator runs.

When the speed command generator 180 of the present invention performs the speed command computation process to alter the acceleration and deceleration according to the car net load and the direction of run, the speed command generator 180 receives a detected load signal 14*a* from a load sensor 14 as a signal 19*c* via a speed control unit 19, determines which setting region the car net load falls in in FIG. 4 and then computes the speed command based on the determination result.

In FIG. 4, NL, BL, FL and OL represent no-load, balanced load, rated load, over-load of the car net weight Wi, and shown here are a first region between a weight W1 that is lighter than the balanced load BL and nearer to the no-load NL side and a weight W2 that is heavier than the balanced load BL and nearer to the rated load FL and the over-load OL sides, a second region that is a light load region between the weight W1 and the no-load NL, and a third region between the weight W2 and the rated load FL or the over-load OL.

When no operation command is issued, the sequence goes from step S30 to step S31 where the speed command generator 180 clears each of the speed command $V_P$, run mode MODE and time T to 0, and sets the maximum speed $V_C$ to a rated speed $V_{TOP}$ as shown in FIG. 2.

When an operation command is issued, a weight signal Wi is checked at steps S32 and S37 as shown in FIG. 3. When the weight signal Wi is smaller than the weight W1 shown in FIG. 4, namely, within the second region of light load, the sequence goes to S33. When the elevator is in the raise operation, the acceleration $\alpha_A$, during acceleration phase is set to a third acceleration $\alpha_3$ that is higher than a normal acceleration $\alpha_1$, $T_A$ to $T_3$, the deceleration $\alpha_B$ during deceleration phase to a second $\alpha_2$ that is lower than the normal acceleration $\alpha_1$ and $T_B$ to $T_2$ at step S34 as shown in the no-load raise waveform (C) in FIG. 5.

Figure 5:
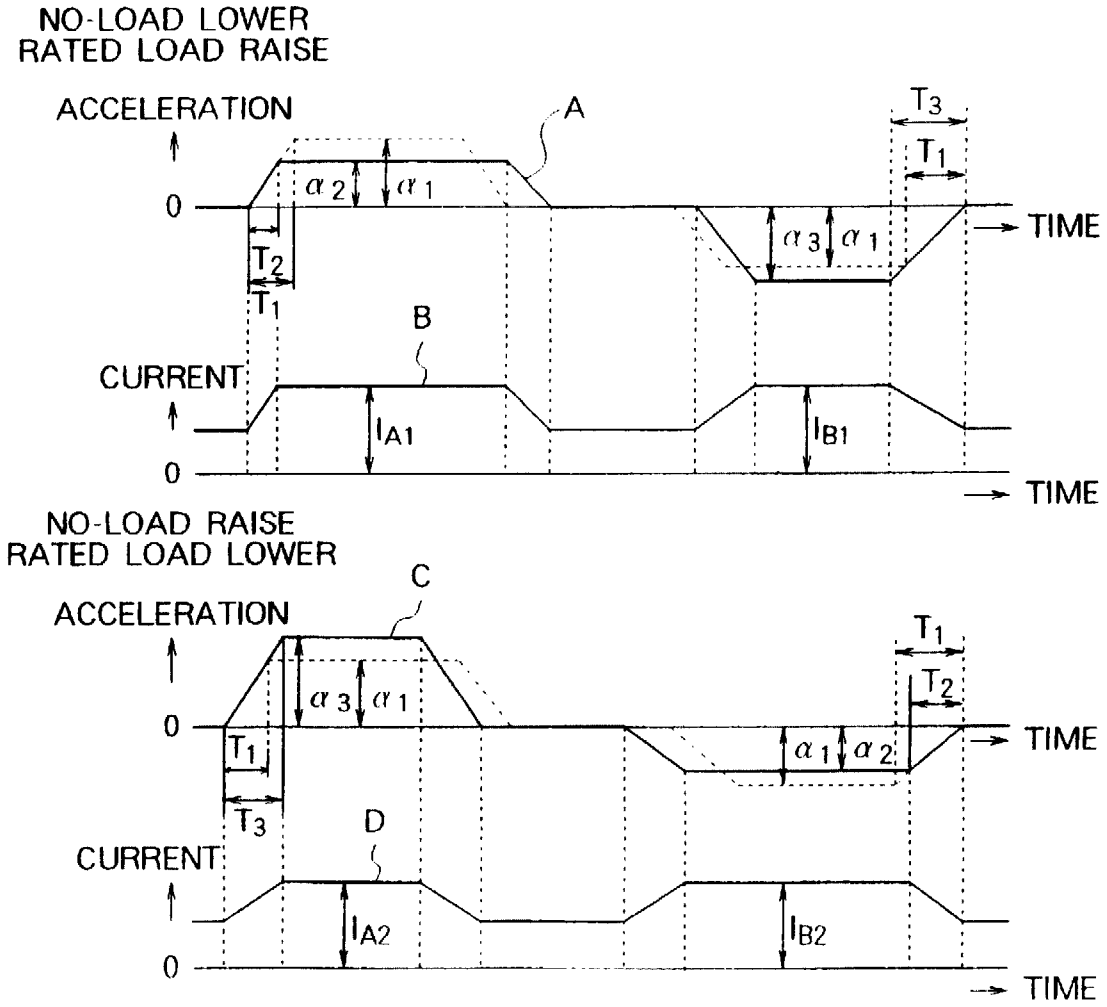
FIG. 5 is a characteristic diagram of the speed command computation process according to embodiment 1, showing the characteristic diagram showing the relationship between the acceleration and the current when the elevator runs.

In a lower operation, the acceleration $\alpha_A$ during acceleration phase is set to the second acceleration a 2 that is lower than the normal acceleration $\alpha_1$, $T_A$ to $T_2$, the deceleration $\alpha_B$ during deceleration phase to the third acceleration $\alpha_3$ that is higher than the normal acceleration and $T_B$ to $T_3$ at step S35 as shown in the no-load lower waveform (A) in FIG. 5. As the accelerations are related as $\alpha_3>\alpha_1>\alpha_2$, times are related as $T_3>T_1>T_2$.

When the car net weight Wi is greater than W1 but smaller than W2 in FIG. 4, namely, within the first region of normal load, the sequence goes to step S38. Both the acceleration $\alpha_A$ during acceleration phase and the deceleration phase $\alpha_B$ during deceleration phase are set to the normal acceleration $\alpha_1$, and both $T_A$ and $T_B$ are set to $T_1$.

When the car net weight Wi is greater than W2, namely, within the third region, the heavy load region, the sequence goes to step S39. In the raise operation, at step S40, the acceleration $\alpha_A$ during acceleration phase is set to the second acceleration $\alpha_2$, $T_A$ to $T_2$, the deceleration $\alpha_B$ during deceleration phase to the third acceleration $\alpha_3$, and $T_B$ to $T_3$ as shown in the waveform (A) in FIG. 5 in the same way as the lower operation with the car net weight in the second region, the light load region.

In the lower operation, at step S41, the acceleration $\alpha_A$ during acceleration phase is set to the third acceleration, $T_A$ to $T_3$, the deceleration $\alpha_A$ during deceleration phase to the second $\alpha_2$, and $T_B$ to $T_2$ as shown in the waveform (C) in FIG. 5 in the same way as the lower operation with the car net weight in the second region, the light load region.

After following any of the steps S34, S35, S38, S40, and S41, the sequence goes to step S36, where set are a speed command $V_{AA}$ (corresponding to $V_A$ on the left-hand side of FIG. 18) at the point where a constant acceleration is reached during acceleration phase, a speed command $V_{BA}$ (corresponding to $V_B$ on the left-hand side of FIG. 18) at the point where the constant acceleration is terminated, a speed command $V_{BB}$ (corresponding to $V_B$ on the right-hand side of FIG. 18) at the point where a constant deceleration is reached during deceleration phase after starting deceleration and a speed command $V_{AB}$ (corresponding to $V_A$ on the right-hand side of FIG. 18) at the point where the constant deceleration is terminated. During acceleration phase, both $\alpha_A$ and $T_A$ are used and during deceleration phase, $\alpha_B$ and $T_B$ are used, and $V_{AA}$ and $V_{AB}$ are determined in the same way as $V_A$ in the known art in FIG. 18 and $V_{BA}$ and $V_{BB}$ are also determined in the same way as $V_B$ in FIG. 18.

Returning to FIG. 2, the sequence follows steps S42 through S62 using $\alpha_A$, $T_A$, $V_{AA}$, and $V_{AB}$ during acceleration phase and $\alpha_B$, $T_B$, $V_{BA}$ and $V_{BB}$ during deceleration phase in the same way as in the known art steps S3 through S23.

As described above, in the no-load lower and no-load raise operations, the resulting accelerations and currents are as shown in waveforms (A) and (B) in FIG. 5. Namely, by decreasing the acceleration during acceleration phase that normally draws a large current, a current $I_{A1}$ is restricted, and by increasing the deceleration during deceleration phase that normally draws a small current, a service time is prevented from being prolonged. The current during deceleration is then $I_1$, and currents $I_{A1}$ and $I_{B1}$ are approximately equal to the current values $I_1$ and $I_2$ during balanced load operation in the known art.

In the no-load raise operation and rated load lower operation the resulting accelerations and currents are as shown in the waveforms (C) and (D) in FIG. 5. By decreasing the deceleration during deceleration phase that normally draws a large current, a current $I_{B2}$ is restricted, and by increasing the acceleration during acceleration phase that normally draws a small current, a service time is prevented from being prolonged. The current during acceleration is then $I_{A2}$, and currents $I_{A2}$ and $I_{B2}$ are approximately equal to the current values $I_1$ and $I_2$ during balanced load operation in the known art.

According to the embodiment 1, by altering the acceleration and deceleration in response to the car net weight and the direction of run, the current drawn by the motor is minimized, and thus an inexpensive and compact elevator control apparatus results without degrading service quality.

Embodiment 2

Figure 6:
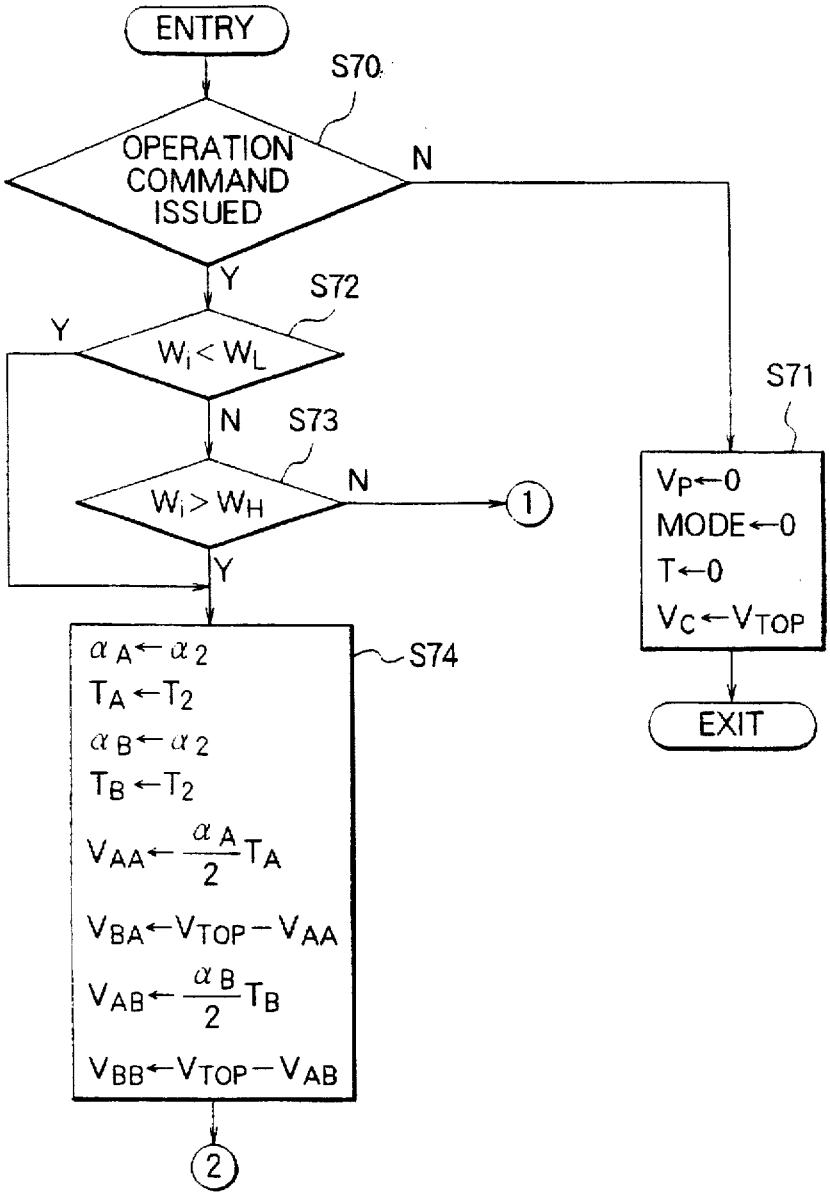
FIG. 6 is a flow diagram showing the speed command computation process of the speed command generator according to embodiment 2 of the present invention.

FIG. 6 is the flow diagram showing the speed command computation process of the speed command generator 180 according to embodiment 2 of the present invention.

When no operation command is issued, the sequence follows steps S70 to S71, which are identical to steps S30 to S31 in embodiment 1.

When an operation command is issued, the load sensor 14 is checked for any fault. A weight signal Wi smaller than a lower limit $W_L$ permissible, or greater than an upper limit $W_H$ permissible determines that a fault takes place. At step S74, both the acceleration $\alpha_A$ during acceleration phase and deceleration $\alpha_B$ during deceleration phase are set to the second acceleration $\alpha_2$ that is lower than the normal acceleration, and both $T_A$ and $T_B$ are set to $T_2$. Based on these values, $V_{AA}$, $V_{BA}$, $V_{AB}$, and $V_{BB}$ are computed.

In the same way as in the embodiment 1, the sequence goes to step S42 in FIG. 2. When no fault is detected in steps S72 and S73, the sequence goes to step S32 in FIG. 3, where the same process thereafter as in the embodiment 1 is taken.

In the embodiment 2, a smaller acceleration is used when a fault is detected in the load sensor 14; thus, safety is enhanced by preventing a current in excess of the capacity of the inverter 4 or the like from flowing therethrough.

Embodiment 3

In embodiment 3, the speed command generator 180 starts with both the acceleration during acceleration phase and the deceleration during deceleration phase set to be either the first acceleration or the third acceleration when a fault is detected in the load sensor 14 as the load sensor means, and based on the current value during acceleration phase detected by the current detector 21, the deceleration during deceleration phase and the acceleration during acceleration phase are altered. This arrangement minimizes the current flowing through the hoisting motor, resulting in a low-cost and compact elevator control apparatus without degrading the quality of elevator service. This embodiment is now discussed.

Figure 7:
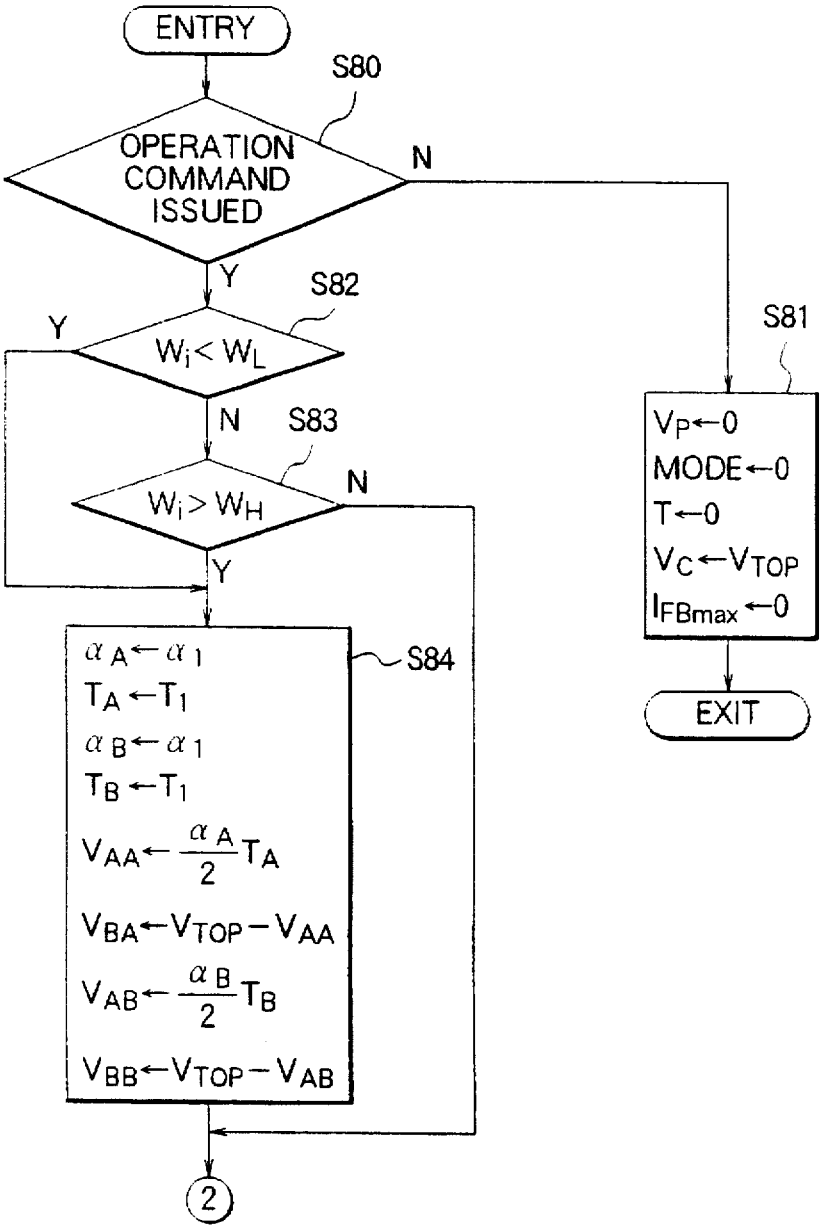
FIG. 7 is a flow diagram showing the speed command computation process of the speed command generator according to embodiment 3 of the present invention.
Figure 8:
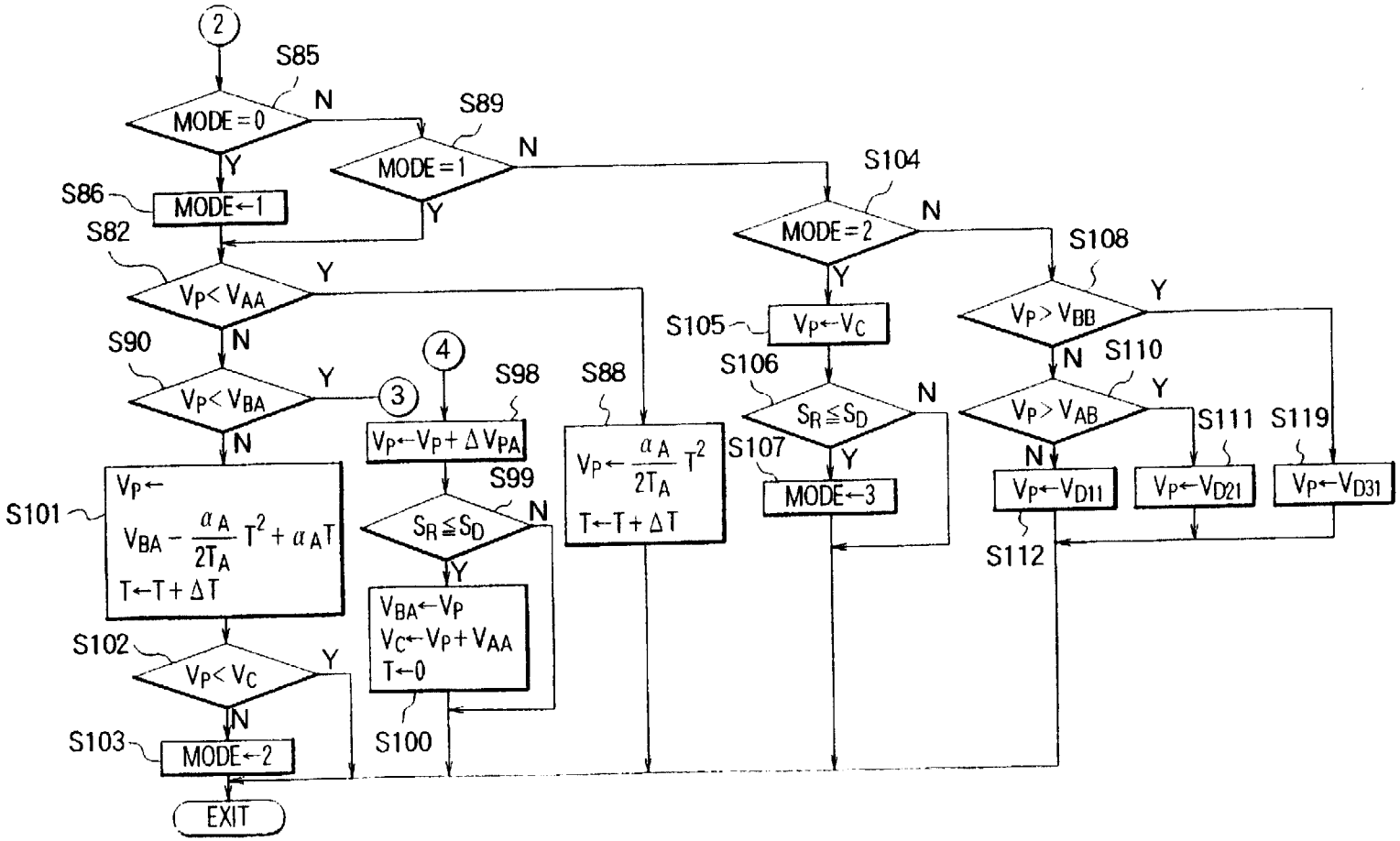
FIG. 8 is a continuation of the flow diagram of FIG. 7, showing the speed command computation process according to embodiment 3.
Figure 9:
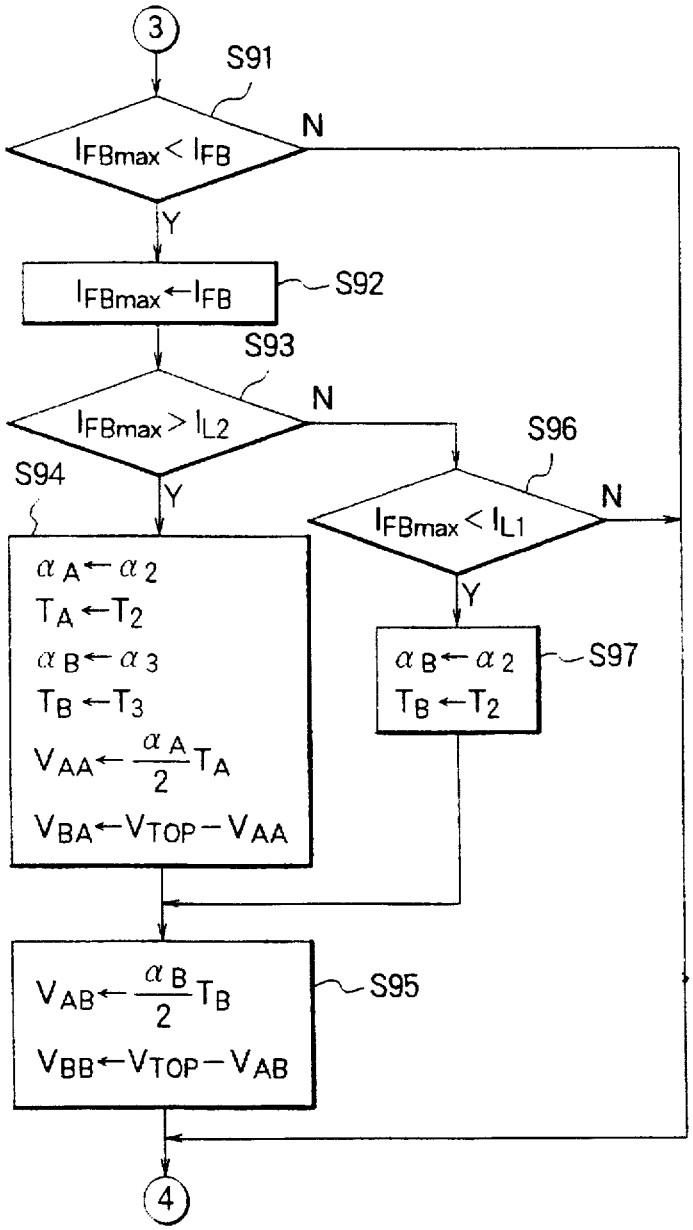
FIG. 9 shows part of the speed command computation process according to embodiment 3 in FIG. 8.

FIGS. 7 through 9 are flow diagrams showing the speed command computation process of the speed command generator 180 according to the embodiment 3.

Steps S80 through S83 in FIG. 7 are identical to above-described steps S70 through S73 except that $I_{FBmax}$ is set to 0 at step S81. When a fault is detected in the load sensor 14, the acceleration $\alpha_A$ during acceleration phase and deceleration $\alpha_B$ during deceleration phase are set to the first acceleration $\alpha_1$, normal acceleration, and $T_A$ and $T_B$ are set to $T_1$. From these values, $V_{AA}$, $V_{BA}$, $V_{AB}$ and $V_{BB}$ are computed, and the sequence goes to step S85 in FIG. 8.

Steps S85 through S90 in FIG. 8 are similar to above steps S42 through S47. When steps S87 and S90 determine that the speed command $V_P$ is a constant acceleration, the sequence goes to step S91 in FIG. 9. When the current detected by the current detector 21, namely, the output current $I_{FB}$ of the inverter 4, exceeds the maximum set current $I_{FBmax}$, $I_{FB}$ updates $I_{FBmax}$ at step S92. This sets the maximum current value during acceleration phase to $I_{FBmax}$. When $I_{FBmax}$ is greater than a second predetermined value $I_{L2}$ at steps S93 through S95, the acceleration $\alpha_A$ during acceleration phase is set to the second acceleration $\alpha_2$, $T_A$ to $T_2$, the deceleration $\alpha_B$ during deceleration phase is set to the third acceleration $\alpha_3$, and $T_B$ to $T_3$, and then $V_{AA}$, $V_{BA}$, $V_{AB}$ and $V_{BB}$ are computed. Since the current during acceleration phase is too large, the acceleration during acceleration phase is decreased, and the deceleration during deceleration phase is increased.

When steps S93 and S96 determine that $I_{FBmax}$ is smaller than the second predetermined value $I_{L2}$, and that $I_{FBmax}$ is smaller than a first predetermined value $I_{L1}$ ($I_{L2}>I_{L1}$) the deceleration $\alpha_B$ the during deceleration phase is set to the second acceleration $\alpha_2$, and $T_B$ to $T_2$ at steps S97, and $V_{AB}$ and $V_{BB}$ are computed at step S95. In summary, a small current during acceleration phase decreases the deceleration during deceleration phase.

After step S95, or when step S96 determines that $I_{FBmax}$ is between $I_{L1}$ and $I_{L2}$, the sequence goes to step S98 in FIG. 8.

Steps S98 through S112 in FIG. 8 are identical to previously described steps S48 through S62.

In the embodiment 3, when a fault in the load sensor 14 is detected, the acceleration $\alpha_A$ during acceleration phase and the deceleration $\alpha_B$ during deceleration phase are set to the first acceleration $\alpha_1$ that is the normal acceleration, at the startup. In the course of the running, the load is judged by the current value during acceleration phase. When the current $I_{FBmax}$ during acceleration phase is greater than the second predetermined value $I_{L2}$, the acceleration $\alpha_A$ during acceleration phase is set to the second acceleration $\alpha_2$ that is lower than the normal acceleration and the deceleration $\alpha_B$ during deceleration phase is set to the third acceleration that is higher than the normal acceleration. When the current $I_{FBmax}$ is smaller than the first predetermined value $I_{L1}$, the deceleration $\alpha_B$ during deceleration phase is set to the second acceleration $\alpha_2$ Thus, when a fault in the load sensor 14 is detected, the deceleration is determined referring to the load that is judged by the current value during acceleration, and the acceleration is also altered if possible. Safety is thus enhanced by preventing a current in excess of the capacity of the inverter 4 and the like from flowing therethrough.

Embodiment 4

Figure 10:
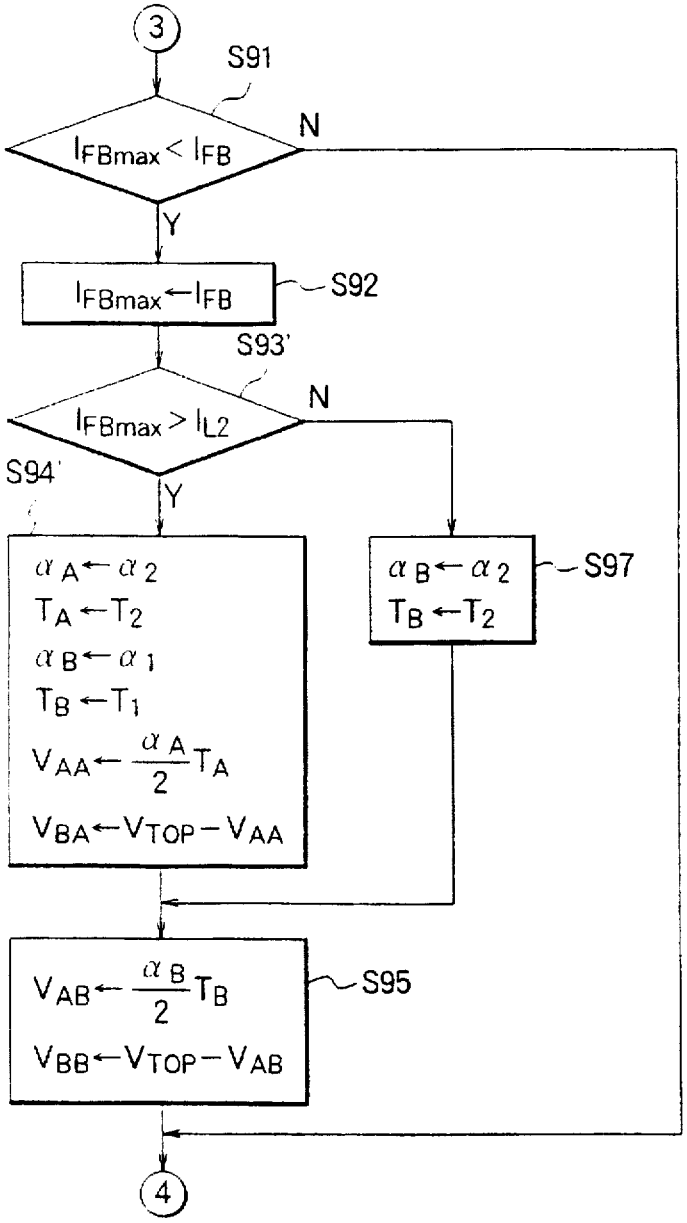
FIG. 10 is a flow diagram showing the speed command computation process of the speed command generator according to embodiment 4 of the present invention.

In embodiment 3, the startup is performed with the acceleration $\alpha_A$ during acceleration phase and deceleration $\alpha_B$ during deceleration are set to the first acceleration a when a fault in the load sensor 14 is detected. Alternatively, however, the startup may be performed at the third acceleration $\alpha_3$ that is higher than the first acceleration a FIG. 10 illustrates the speed command computation process of the speed command generator 180 according to the embodiment 4, showing part of the process of the embodiment 4 corresponding to the process of the embodiment 3 in FIG. 9. The embodiment 4 differs from step S84 in FIG. 7 in that $\alpha_A$ is set to $\alpha_3$, $T_A$ to $T_3$, $\alpha_B$ to $\alpha_3$, and $T_B$ to $T_3$. When at step S93' in FIG. 10 corresponding to step S93 in FIG. 9, it is determined that the current value $I_{FBmax}$ during acceleration phase is not greater than the second predetermined value $I_{L2}$, the sequence goes to step S97 not via step S96 as in FIG. 9. At step S97, $\alpha_B$ is set to $\alpha_2$, and $T_B$ to $T_2$. When at step S93' it is determined that the current value $I_{FBmax}$ during acceleration is greater than the second predetermined value $I_{L2}$, $\alpha_B$ is set to $\alpha_1$ and $T_B$ to $T_1$ at step S94' corresponding to step S94 in FIG. 9.

The startup is performed with the acceleration during acceleration phase and the deceleration during deceleration phase set to the third acceleration $\alpha_3$ that is higher than the normal acceleration. When the current value $I_{FBmax}$ during acceleration phase is smaller than the second predetermined value $I_{L2}$, namely, when a light load acts at acceleration phase with a heavy load at deceleration, the deceleration during deceleration phase is set to the second acceleration $\alpha_2$ that is lower than the normal acceleration. When the current value $I_{FBmax}$ during acceleration phase exceeds the second predetermined value $I_{L2}$, namely, when a heavy load or a balanced load acts during acceleration phase with a light load or balanced load acting during deceleration phase, the deceleration during deceleration phase is set to the first acceleration a that is the normal acceleration while the acceleration during acceleration phase is altered to the second acceleration $\alpha_2$ Therefore, when a fault in the load sensor 14 is detected, the startup is performed at the acceleration and deceleration greater than the normal acceleration, and thus, the time required to travel the same distance is reduced according to the degree of increase of the acceleration and deceleration, and thus the degradation of the quality of service is avoided. After the startup, the load condition is judged by the current value during the acceleration phase, and then the acceleration and deceleration are altered accordingly. Safety is thus enhanced by preventing a current in excess of the capacity of the inverter 4 and the like from flowing therethrough.

Embodiment 5

In embodiment 3, when a fault in the load sensor 14 is detected, the startup is performed with the acceleration $\alpha_A$ during acceleration phase and the deceleration $\alpha_B$ during the deceleration phase set to the first acceleration $\alpha_1$ that is the normal acceleration. Alternatively, however, the startup may be performed at the second acceleration $\alpha_2$ that is lower than the first acceleration $\alpha_1$.

Figure 11:
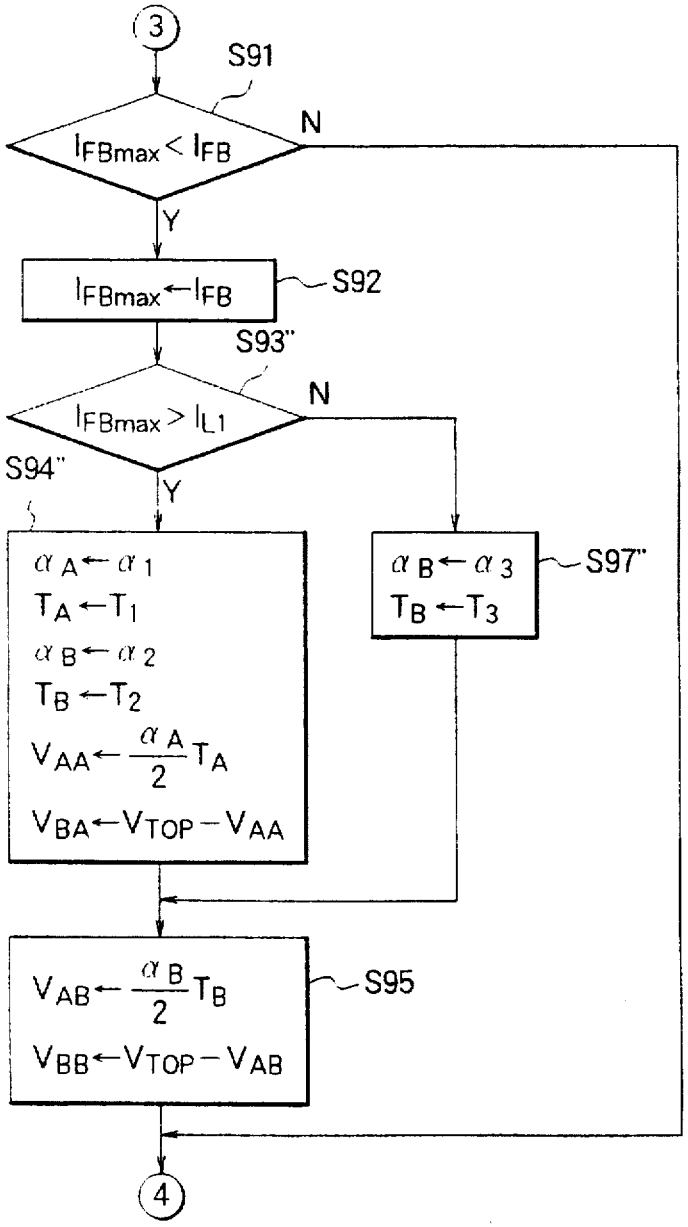
FIG. 11 is a flow diagram showing the speed command computation process of the speed command generator according to embodiment 5 of the present invention.

FIG. 11 illustrates the speed command computation process of the speed command generator 180 according to the embodiment 5, showing part of the process of the embodiment 5 corresponding to the process of the embodiment 3 in FIG. 9.

The embodiment 5 differs from step S84 in FIG. 7 in that $\alpha_A$ is set to $\alpha_2$, $T_A$ to $T_2$, $\alpha_B$ to $\alpha_2$, and $T_B$ to $T_2$. When at step S93' in FIG. 11 corresponding to step S93 in FIG. 9, it is determined that the current value $I_{FBmax}$ during acceleration phase is greater than the first predetermined value $I_{L1}$, the sequence goes to step S97" not via step S96 as in FIG. 9. At step S97", $\alpha_B$ is set to a 3, and $T_B$ to $T_3$. At step S94", $\alpha_A$ is set to a 1, $T_A$ to $T_1$, $\alpha_B$ to $\alpha_2$, and $T_B$ to $T_2$ The startup is performed with the acceleration during acceleration phase and the deceleration during deceleration phase set to the second acceleration $\alpha_2$ that is lower than the normal acceleration. When the current value $I_{FBmax}$ during acceleration phase is higher than the first predetermined value $I_{L1}$, namely, when a heavy load acts during acceleration phase with a light load at deceleration, the deceleration during deceleration phase is set to the third acceleration $\alpha_3$ that is higher than the normal acceleration.

When the current value $I_{FBmax}$ during acceleration phase is lower than the first predetermined value $I_{L1}$, namely, when a light load or a balanced load acts during acceleration phase with a heavy load or balanced load acting during deceleration phase, the deceleration during deceleration phase is set to the second acceleration $\alpha_2$ that is smaller than the normal acceleration while the acceleration during acceleration phase is altered to the first acceleration a that is the normal acceleration.

Therefore, when a fault in the load sensor 14 is detected, the startup is performed at the acceleration and deceleration smaller than the normal acceleration, and safety is thus enhanced by preventing a current in excess of the capacity of the inverter 4 and the like from flowing therethrough. After the startup, the load condition is judged by the current value during acceleration phase, and then the acceleration and deceleration are altered accordingly. The time required to travel the same distance is reduced according to the degree of decrease of the acceleration and deceleration.

The embodiments 3 and 5 are based on the assumption that the load sensor 14 is faulty, namely, the load condition cannot be detected. Even if sensor means, such as a load sensor for sensing the load condition, is not available or even if a fault in the load sensor means is not recognized as a fault, the load condition will be detected according to the current during acceleration phase and is used to provide the same advantages as described above. In this case, steps S82 and S83 are removed from the flow diagram in FIG. 7.

Embodiment 6

Figure 12:
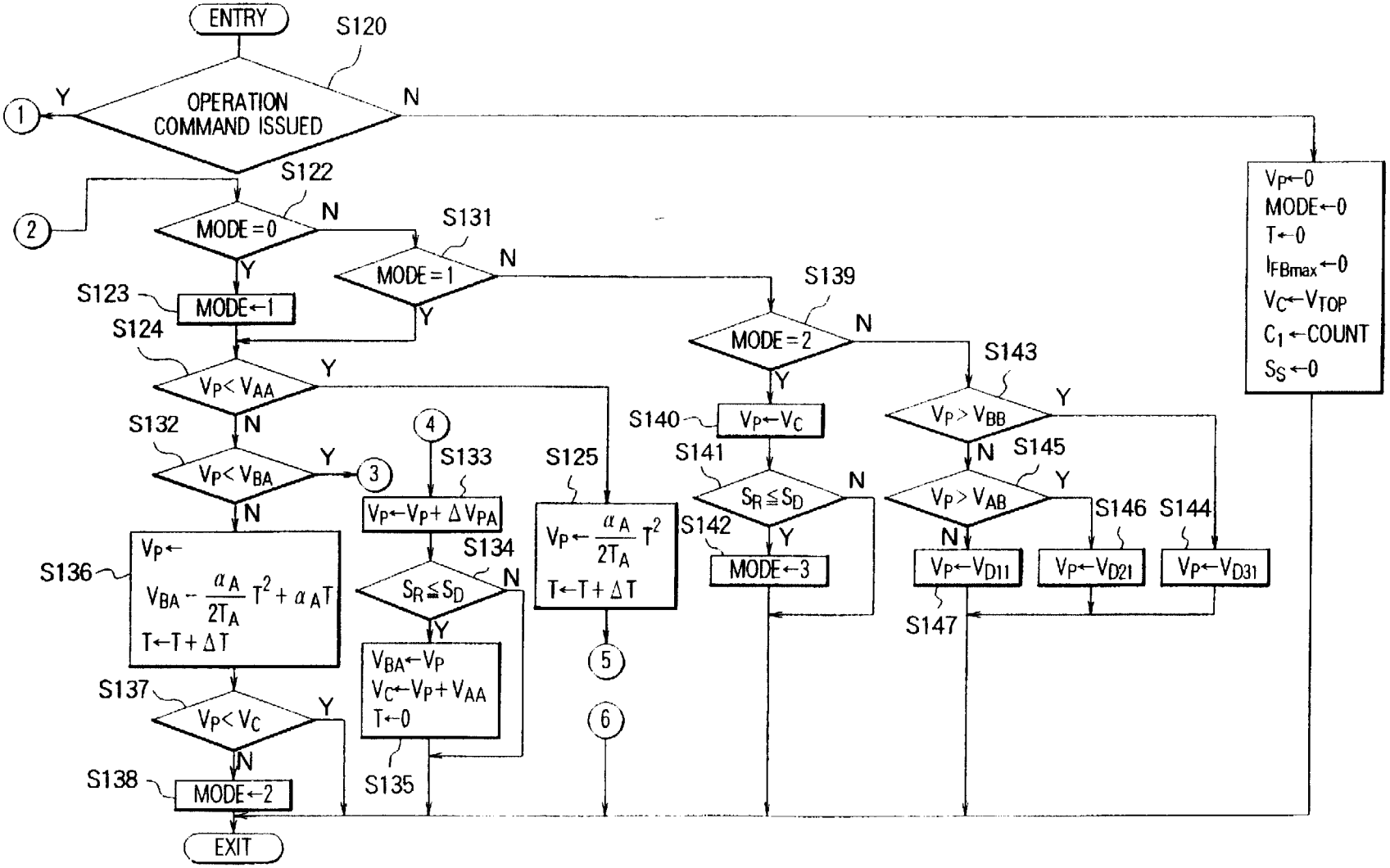
FIG. 12 is a flow diagram showing the speed command computation process of the speed command generator according to embodiment 6 of the present invention.
Figure 13:
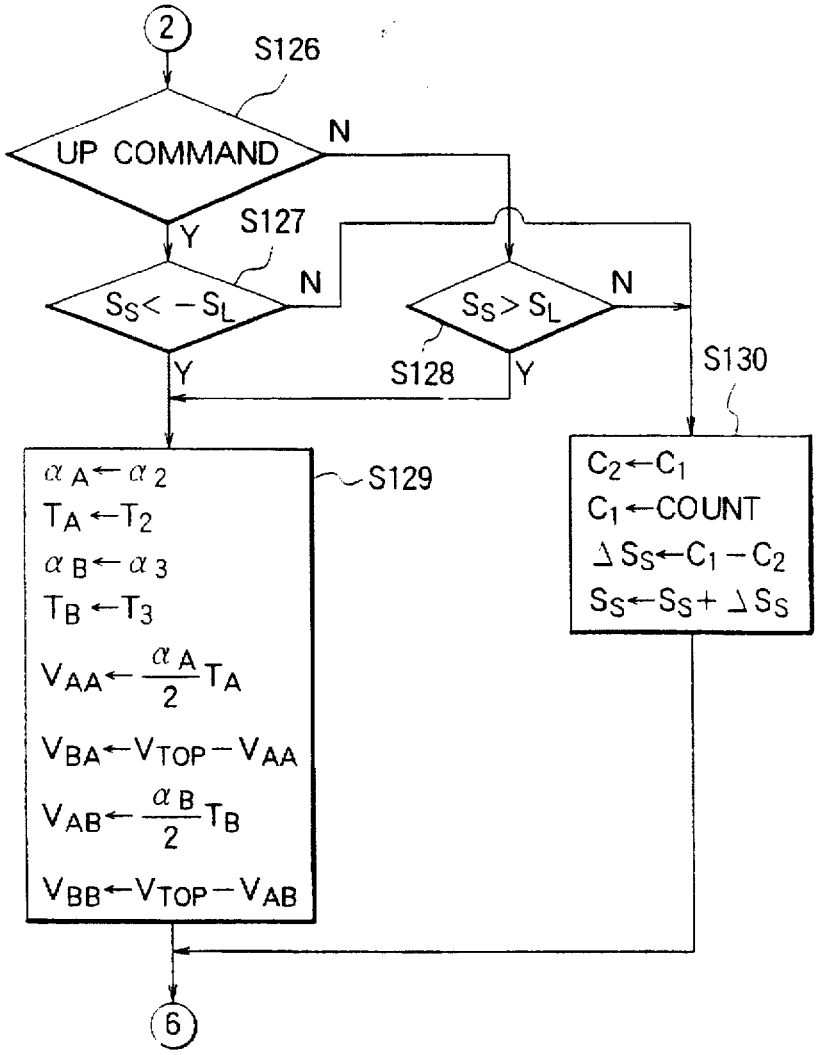
FIG. 13 is a flow diagram of part of the speed command computation process according to embodiment 6 in FIG. 12.
Figure 14:
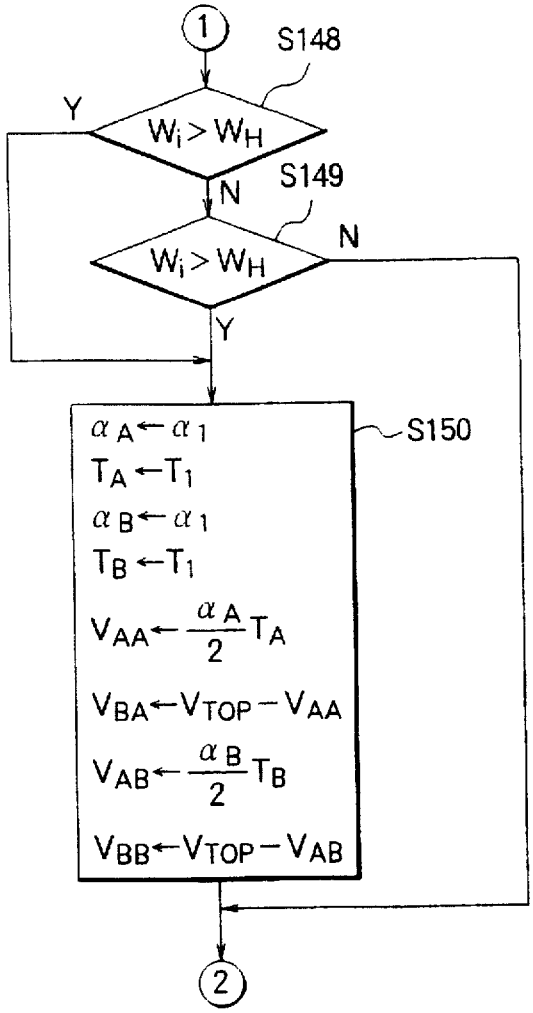
FIG. 14 shows part of the speed command computation process in embodiment 6 in FIG. 13.

FIGS. 12 through 14 are the flow diagrams showing the speed command computation process of the speed command generator 180 according to embodiment 6 of the present invention.

When no operation command is issued in FIG. 12, the sequence goes from step S120 to step S121, where a count input by the detected position signal 12*a* is entered for $C_1$ and O is entered for distance data $S_S$.

When an operation command is issued at step S120, steps S148 through S150 in FIG. 14 are performed when the load sensor 14 is faulty, in the same way as in step S84, namely, both the acceleration during acceleration phase and the deceleration during deceleration phase are set to the normal acceleration. Specifically, $\alpha_A$ is set to a $I_1$ $T_A$ to $T_1$, $\alpha_B$ to $\alpha_1$, and $T_B$ to $T_1$.

At steps S122 through S125 in FIG. 12, the process identical to that at steps S85 through S88 is performed. Steps S126 through 130 in FIG. 13 check for a reverse running (rollback) at the startup.

In the raise operation, when the integral value of distance run from the startup based on the detected position signal from the position sensor 12 as position sensor means of the elevator car exceeds, in a negative direction, a predetermined distance $S_L$ at step S127, the sequence goes to step S129.

In the lower operation, when the integral value of distance run from the startup exceeds, in a positive direction, a predetermined distance $S_L$ at step S128, the sequence goes to step S129. At step S129, the acceleration $\alpha_A$ during acceleration phase is set to the second acceleration $\alpha_2$, $T_A$ to $T_2$, the deceleration $\alpha_B$ during deceleration phase to the third acceleration $\alpha_3$, and $T_B$ to $T_3$, and $V_{AA}$, $V_{BA}$, $V_{AB}$, and $V_{BB}$ are computed in the same manner already described. Steps S131 through S147 in FIG. 12 are identical to steps S89 through S112.

In the embodiment 6, the acceleration and deceleration are selected by judging the load condition by the distance of reverse travel of the car immediately after the release of a brake, based on the phenomenon that the reverse run of the car 6 at the startup involves more torque, drawing a larger current. This arrangement minimizes the current flowing through the hoisting motor, resulting in a low-cost and compact elevator control apparatus without degrading the quality of elevator service.

Embodiment 6 is based on the assumption that the load sensor 14 is faulty, namely, the load condition cannot be detected. Even if sensor means such as a load sensor for sensing the load condition is not available or even if a fault in the load sensor mean means is not recognized as a fault, the load condition will be judged by the reverse distance run and is used to provide the same advantages as described above. In this case, steps S148 and S149 are removed from the flow diagram in FIG. 14.

What is claimed is:

1. A control apparatus for an elevator comprising:

power converter means for converting an alternating current into an alternating current of arbitrary frequency and voltage;

a hoisting motor for raising an elevator car, said hoisting motor being powered by said power converter means;

load sensor means for sensing a net load of the elevator car and outputting a detected load signal indicative of the net load;

an operation management unit for issuing an operation command and a direction signal to the elevator car in response to a button signal generated by at least one of a destination button installed in the elevator car and a boarding button installed at an elevator station;

a speed command generator for computing a speed command responsive to:

the distance to a destination floor based on the operation command, the direction signal of the elevator car issued by said operation management unit, and the detected load signal from said load sensor means; and a speed control unit for controlling the speed of said hoisting motor by issuing a driving command to said power converter means in response to the speed command from said speed command generator, wherein:

said speed command generator sets both the acceleration of the speed command during an acceleration phase and the deceleration of the speed command during a deceleration phase to a first acceleration when the net load of the elevator car is within a normal load region, the normal load region including a balanced load, said speed command generator sets the acceleration of the speed command during the acceleration phase to a second acceleration, lower than the first accelerations and the deceleration of the speed command during the deceleration phase to a third acceleration, higher than the first acceleration, when the elevator car is being lowered and the net load of the elevator car is in a light load region, wherein the net load of the elevator car ranges from a no-load condition to the normal load region, said speed command generator sets the acceleration of the speed command during the acceleration phase to the third acceleration and the deceleration of the speed command during the deceleration phase to the second acceleration when the elevator car is being raised and the net load of the elevator car is within the light load region, said speed command generator sets the acceleration of the speed command during the acceleration phase to the second acceleration and the deceleration of the speed command during the deceleration phase to the third acceleration when the elevator car is being raised and the net load of the elevator car is within a heavy load region wherein the net load of the elevator car exceeds the normal load region, said speed command generator sets the acceleration of the speed command during the acceleration phase to the third acceleration and the deceleration of the speed command during the deceleration phase to the second acceleration when the car is being lowered and the net load of the elevator car is within the heavy load region and said speed command generator sets both the acceleration during the acceleration Phase and the deceleration during the deceleration phase to the second acceleration when a fault in said load sensor means is detected.

2. A control apparatus for an elevator comprising:

power converter means for converting an alternating current into an alternating current of arbitrary frequency and voltage;

a hoisting motor for raising an elevator car, said hoisting motor being powered by said power converter means;

load sensor means for sensing a net load of the elevator car and outputting a detected load signal indicative of the net load;

an operation management unit for issuing an operation command and a direction signal to the elevator car in response to a button signal generated by at least one of a destination button installed in the elevator car and a boarding button installed at an elevator station;

a speed command generator for computing a speed command responsive to:

the distance to a destination floor based on the operation command, the direction signal of the elevator car issued by said operation management unit, and the detected load signal from said load sensor means; and a speed control unit for controlling the speed of said hoisting motor by issuing a driving command to said power converter means in response to the speed command from said speed command generator, wherein:

said speed command generator sets both the acceleration of the speed command during an acceleration phase and the deceleration of the speed command during a deceleration phase to be a first acceleration when the net load of the elevator car is within a normal load region the normal load region including a balanced load, said speed command generator sets the acceleration of the speed command during the acceleration phase to a second acceleration, lower than the first acceleration, and the deceleration of the speed command during the deceleration phase to a third acceleration, higher than the first acceleration, when the elevator car is being lowered and the net load of the elevator car is in a light load region, wherein the net load of the elevator car ranges from a no-load condition to the normal load region, said speed command generator sets the acceleration of the speed command during the acceleration phase to the third acceleration and the deceleration of the speed command during the deceleration phase to the second acceleration, when the elevator car is being raised and the net load of the elevator car is within the light load region, said speed command generator sets the acceleration of the speed command during the acceleration phase to the second acceleration and the deceleration of the speed command during the deceleration phase to the third acceleration, when the elevator car is being raised and the net load of the elevator car is within a heavy load region, wherein the net load of the elevator car exceeds the normal load region, said speed command generator sets the acceleration of the speed command during the acceleration phase to the third acceleration and the deceleration of the speed command during the deceleration phase to the second acceleration, when the car is being lowered and the net load of the elevator car is within the heavy load region; and current detector means for detecting a current flowing through said hoisting motor for raising the elevator car, wherein:

said speed command generator starts with both the acceleration during the acceleration phase and the deceleration during the deceleration phase set to at least one of the first acceleration and the third acceleration when a fault is detected in said load sensor means, and said speed command generator changes the deceleration during the deceleration chase and the acceleration during the acceleration phase based on the current detected by said current detector means during the acceleration phase.

3. The control apparatus for an elevator according to claim 2, wherein:

said speed command generator starts with the acceleration during the acceleration phase and the deceleration during the deceleration phase set to the first acceleration, said speed command generator sets the deceleration during the deceleration phase to the second acceleration when the current detected by said current detector means during the acceleration phase is lower than a first value, and said speed command generator sets the deceleration during the deceleration phase to the third acceleration and the acceleration during the acceleration phase to the second acceleration when the current detected by said current detector means during the acceleration phase is higher than a second value, higher than the first value.

4. The control apparatus for an elevator according to claim 2, wherein:

said speed command generator starts with the acceleration during the acceleration phase and the deceleration during the deceleration phase set to the third acceleration, said speed command generator sets the deceleration during the deceleration phase to the second acceleration when the current detected by said current detector means during the acceleration phase is lower than a first value, and said speed command generator sets the deceleration during the deceleration phase to the first acceleration and the acceleration during the acceleration phase to the second acceleration when the current detected by said current detector means during the acceleration phase is higher than the first value.

5. The control apparatus for an elevator according to claim 2, wherein:

said speed command generator starts with the acceleration during the acceleration phase and the deceleration during the deceleration phase set to the second acceleration, said speed command generator sets the deceleration during the deceleration phase to the third acceleration when the current detected by said current detector means during the acceleration phase is higher than a first value, and said speed command generator sets the deceleration during the deceleration phase to the second acceleration and the acceleration during the acceleration phase to the first acceleration when the current detected by said current detector means during the acceleration phase is lower than the first value.

6. The control apparatus for an elevator according to claim 2 comprising:

position sensor means for detecting the current position of the elevator car and outputting a position signal indicative of the current position, wherein:

said speed command generator starts with both the acceleration during the acceleration phase and the deceleration during the deceleration phase set to the first acceleration when the net load of the elevator car is within the normal load region, and said speed command generator sets the acceleration during the acceleration phase to the second acceleration and the deceleration during the deceleration phase to the third acceleration when the position signal indicates that a rollback distance of the elevator car exceeds a predetermined distance.

7. A control apparatus for an elevator comprising:

power converter means for converting an alternating current into an alternating current of arbitrary frequency and voltage;

a hoisting motor for raising an elevator car, said hoisting motor being powered by said sower converter means;

load sensor means for sensing a net load of the elevator car and outputting a detected load signal indicative of the net load;

an operation management unit for issuing an operation command and a direction signal to the elevator car in response to a button signal generated by at least one of a destination button installed in the elevator car and a boarding button installed at an elevator station;

a speed command generator for computing a speed command responsive to:

to the distance to a destination floor based on the operation command, the direction signal of the elevator car issued by said operation management unit, and the detected load signal from said load sensor means; and a speed control unit for controlling the speed of said hoisting motor by issuing a driving command to said power converter means in response to the speed command from said speed command generator, wherein:

said speed command generator sets both the acceleration of the speed command during an acceleration phase and the deceleration of the speed command during a deceleration phase to a first acceleration when the net load of the elevator car is within a normal load region, the normal load region including a balanced load, said speed command generator sets the acceleration of the speed command during acceleration phase to a second acceleration that is lower than the first acceleration and the deceleration of the speed command during the deceleration phase to a third acceleration, higher than the first acceleration, when the elevator car is being lowered and the net load of the elevator car is in a light load region, wherein the net load of the elevator car ranges from a no-load condition to the normal load region, said speed command generator sets the acceleration of the speed command during the acceleration phase to the third acceleration and the deceleration of the speed command during the deceleration phase to the second acceleration, when the elevator car is being raised and the net load of the elevator car is within the light load region, said speed command generator sets the acceleration of the speed command during the acceleration phase to the second acceleration and the deceleration of the speed command during the deceleration phase to the third acceleration, when the elevator car is being raised and the net load of the elevator car is within a heavy load region, wherein the net load of the elevator car exceeds the normal load region, said speed command generator sets the acceleration of the speed command during the acceleration phase to the third acceleration and the deceleration of the speed command during the deceleration phase to the second acceleration, when the car is being lowered and the net load of the elevator car is within the heavy load region, and current detector means for detecting a current flowing through said hoisting motor for raising the elevator car, wherein:

said speed command generator starts with both the acceleration during the acceleration phase and the deceleration during the deceleration phase set to at least one of the first acceleration and the third acceleration and changes the deceleration during the deceleration phase and the acceleration during the acceleration phase based on the current detected by said current detector means during the acceleration phase.

8. The control apparatus for an elevator according to claim 7, wherein:

said speed command generator starts with the acceleration during the acceleration phase and the deceleration during the deceleration phase set to the first acceleration, said speed command generator sets the deceleration during the deceleration phase to the second acceleration when the current detected by said current detector means during the acceleration phase is lower than a first value, and said speed command generator sets the deceleration during the deceleration phase to the third acceleration and the acceleration during the acceleration phase to the second acceleration when the current detected by said current detector means during the acceleration phase is higher than a second value that is higher than the first value.

9. The control apparatus for an elevator according to claim 7, wherein:

said speed command generator starts with the acceleration during the acceleration phase and the deceleration during the deceleration phase set to the third acceleration, said speed command generator sets the deceleration during the deceleration phase to the second acceleration when the current detected by said current detector means during the acceleration phase is lower than a first value, and said speed command generator sets the deceleration during the deceleration phase to the first acceleration and the acceleration during the acceleration phase to the second acceleration when the current detected by said current detector means during the acceleration phase is higher than the first value.

10. The control apparatus for an elevator according to claim 7, wherein:

said speed command generator starts with the acceleration during the acceleration phase and the deceleration during the deceleration phase set to the second acceleration, said speed command generator sets the deceleration during the deceleration phase to the third acceleration when the current detected by said current detector means during the acceleration phase is higher than a first value, and said speed command generator sets the deceleration during the deceleration phase to the second acceleration and the acceleration during the acceleration phase to the first acceleration when the current detected by said current detector means during the acceleration phase is lower than the first value.

11. The control apparatus for an elevator according to claim 7 comprising:

position sensor means for detecting the current position of the elevator car and outputting a position signal indicative of the current position, wherein:

said speed command generator starts with both the acceleration during the acceleration phase and the deceleration during the deceleration phase set to the first acceleration when the net load of the elevator car is within the normal load region, and said speed command generator sets the acceleration during the acceleration phase to the second acceleration and the deceleration during the deceleration phase to the third acceleration when the position signal indicates that a rollback distance of the elevator car exceeds a first distance.

* * * * *

UNITED STATES PATENT AND TRADEMARK OFFICE

CERTIFICATE OF CORRECTION

PATENT NO. : 5,780,786

DATED : July 14, 1998

INVENTOR(S) : Miyanishi

It is certified that error appears in the above-identified patent and that said Letters Patent is hereby corrected as shown below:

Column 15, Line 6-7, change "accelerations" to --acceleration,--;

Line 34, after "region insert --,--;

Line 37, change "Phase" to --phase--;

Column 16, Line 4, after "region" (1st occurrence), insert --,--:

Line 48, change "chase" to --phase--;

Column 17, Line 58, change, "sower" to --power--;

Column 18, Line 3, delete "to" (1st occurrence).

Signed and Sealed this

First Day of December, 1998

*Attest:*

*Attesting Officer*

BRUCE LEHMAN

*Commissioner of Patents and Trademarks*